US008540444B2

(12) United States Patent
Vandermeulen et al.

(10) Patent No.: US 8,540,444 B2
(45) Date of Patent: Sep. 24, 2013

(54) CASSETTE LOCKING AND EJECTING ARRANGEMENT

(75) Inventors: Kris Vandermeulen, Bornem (BE); Erwin Vereecken, Stekene (BE)

(73) Assignee: Dymo, Sint-Niklaas (BE)

( * ) Notice: Subject to any disclaimer, the term of this patent is extended or adjusted under 35 U.S.C. 154(b) by 1007 days.

(21) Appl. No.: 11/658,907

(22) PCT Filed: Jul. 29, 2005

(86) PCT No.: PCT/IB2005/002518

§ 371 (c)(1),
(2), (4) Date: Jun. 13, 2008

(87) PCT Pub. No.: WO2006/013466

PCT Pub. Date: Feb. 9, 2006

(65) Prior Publication Data

US 2009/0190988 A1 Jul. 30, 2009

(30) Foreign Application Priority Data

Jul. 30, 2004 (GB) ..... 0417088.2
May 16, 2005 (GB) ..... 0511371.7

(51) Int. Cl.
*B41J 5/22* (2006.01)

(52) U.S. Cl.
USPC ..... 400/663; 400/664; 400/668; 400/613; 400/88

(58) Field of Classification Search
USPC ..... 400/663, 664, 668, 589, 611, 103, 400/109, 109.1, 88, 583; 347/214
See application file for complete search history.

(56) References Cited

U.S. PATENT DOCUMENTS

| | | | | |
|---|---|---|---|---|
| 4,498,950 | A | 2/1985 | Sato et al. | |
| 5,078,523 | A | 1/1992 | McGourty et al. | |
| 5,435,657 | A * | 7/1995 | Pearce et al. | 400/208 |
| 5,806,995 | A | 9/1998 | Tsushima et al. | |
| 5,921,688 | A * | 7/1999 | Furuya et al. | 400/207 |
| 6,367,995 | B1 * | 4/2002 | Hashimoto et al. | 400/207 |
| 6,503,005 | B1 | 1/2003 | Cockerill et al. | |
| 2006/0245811 | A1 * | 11/2006 | Mochizuki | 400/693 |

FOREIGN PATENT DOCUMENTS

| | | |
|---|---|---|
| DE | 41 23 868 | 1/1992 |
| EP | 0 272 232 | 6/1988 |
| EP | 0 661 163 | 7/1995 |

(Continued)

OTHER PUBLICATIONS

International Search Report for International Application No. PCT/IB2005/002518, dated Apr. 13, 2007.

(Continued)

*Primary Examiner* — Matthew G Marini
(74) *Attorney, Agent, or Firm* — Marshall, Gerstein & Borun LLP

(57) ABSTRACT

A label printer comprising a cassette-receiving bay, said cassette-receiving bay having a base, a top opening opposite the base, and a locking mechanism extending from said base, said locking mechanism having a locking part, said locking part being movable in a first direction and biased in a second direction opposite to said first direction, said locking part having one or more projections such that a force thereon directed towards said base causes the locking part to move in the first direction and wherein said locking part is biased to move in said second direction when the force is removed.

7 Claims, 28 Drawing Sheets

(56) References Cited

FOREIGN PATENT DOCUMENTS

| | | | | |
|---|---|---|---|---|
| GB | 2 250 013 | | | 5/1992 |
| JP | 60172575 | A | * | 9/1985 |
| JP | 62220376 | A | * | 9/1987 |
| JP | 62-256675 | | | 11/1987 |
| JP | 63207673 | A | * | 8/1988 |
| WO | WO-99/20471 | | | 4/1999 |
| WO | WO-2004/059241 | A2 | | 7/2004 |

OTHER PUBLICATIONS

Written Opinion for International Application No. PCT/IB2005/002518, dated Apr. 13, 2007.

* cited by examiner

CASSETTE LOCKING AND EJECTING ARRANGEMENT

BACKGROUND OF THE INVENTION

1. Field of the Invention

The present invention relates to a label printer, and particularly to an arrangement for locking a cassette into a label printer and ejecting it.

2. Related Technology

Label printers are known, which use a supply of tape, housed in a cassette, received in the label printer. The tape comprises an image receiving layer and a backing layer which are secured to one another via an adhesive layer. Such label printers include a cutting mechanism for cutting off a portion of the tape after an image has been printed onto the image-receiving layer so that the portion of tape having the image can be used as a label. After the tape has been cut, the cut portion of the tape is pulled from the printer through a slit in the printer housing. The backing layer can then be removed allowing the image-receiving layer to be secured to an object using the adhesive layer Known label printers comprise a cassette-receiving bay in which a cassette is received for printing. A printhead is provided in the cassette-receiving bay for co-operating with the supply of tape to print thereon. A platen may also be provided in the cassette-receiving bay positioned at a side of the tape opposite to the printhead when the cassette is received in the cassette-receiving bay. During printing, the printhead co-operates with the platen, with the tape passing therebetween for printing thereon. The platen may be driven by a motor for propagating the tape during printing. Alternatively, the platen may be freely rotatable and an additional drive roller is then provided for driving the tape during printing.

In an alternative arrangement to that described above, a platen may be provided within the cassette. In such an arrangement, the tape cooperates with a surface of the platen. When received in the cassette-receiving bay the platen in the cassette co-operates with a drive mechanism in the cassette-receiving bay for driving the tape during printing. Alternatively, the platen is freely rotatable and an additional drive roll is provided for driving the tape. During printing, the printhead in the cassette-receiving bay co-operates with the platen in the cassette with tape passing therebetween for printing thereon.

In one arrangement, the printhead is moveable between a non-printing position and a printing position. In an alternative arrangement, the platen is moveable between a non-printing position and a printing position. In yet another arrangement, both the platen and printhead are movable so as to have non-printing and printing positions.

The tape may be of a direct thermal type on which printing is achieved by direct application of heat from printing elements on the printhead. Alternatively, an ink ribbon may be provided, whereby ink is transferred from the ribbon to an image receiving tape by application of heat to the ink ribbon via printing elements on the printhead. The cassette may include a roll of die cut labels rather than a continuous tape.

In all the above-described arrangements, a problem exists in that for good quality printing the tape and/or ink ribbon must be correctly aligned with the printhead during printing. Furthermore, the tape must remain correctly aligned with the printhead while printing occurs and must smoothly pass the printhead so as to ensure good quality printing. In order to ensure that this is the case, it is advantageous to prevent the cassette from moving during printing. Furthermore, the position of the cassette within the cassette-receiving bay should be predefined and readily reproducible whenever a cassette is inserted in the cassette-receiving bay.

In existing arrangements, this is achieved indirectly by the provision of one or more longitudinal drive shafts which project from the cassette-receiving bay floor and which cooperate with one or more tape/ink ribbon spools and/or a drive roller in the cassette. In one arrangement location and support posts are provided on the base plate, snaps are provided on the print head cowl and a cassette retaining spring is provided or positioning the cassette. Locating the cassette on these elongate members results in the cassette position being approximately in the same place whenever a cassette is placed in the cassette-receiving bay. However, in such an arrangement, the height of the cassette may vary if the cassette is not fully pushed downwards into the cassette-receiving bay. Furthermore, there is a certain amount of free play between the elongate members and the spools in the cassette. Accordingly, the cassette is moveable by a small amount within the cassette-receiving bay. This can lead to misalignment of the tape and/or ink ribbon between the platen roller and print head during printing. Furthermore, if the cassette moves when printing is taking place, the tape may become creased or folded leading to poor print quality and in a worst case scenario the tape may become snagged in the mechanism which can lead to damage of the tape supply and/or the printer.

The problem is exacerbated in hand held printers which may be moved around during printing. In such an apparatus, it is even more important that the cassette is locked in a fixed position during printing.

Two types of cassette locking mechanisms are described in WO 2004/059241. In the arrangement illustrated in FIG. 11 a of this document, a cassette-receiving bay is shown in which a tape cassette is inserted in a direction perpendicular to the axis of rotation of the supply spool in the cassette. The cassette-receiving bay comprises two plate like members which extend in a direction parallel to the direction of insertion of the cassette. The plate like members cooperate with opposing sides of the cassette. The plate like members are moveable whereby they are moved apart to insert the cassette and then moved together to grip the cassette. A sprocket extends from one of said plate like members so as to co-operate with a spool in the tape cassette.

In an alternative arrangement illustrated in FIGS. 15 to 18*c* of WO 2004/059241 a locking ring mechanism and cassette are shown. In the cassette, flanges form a recess for receiving an idler roller of the printer which the emerging tape moves against as shown in FIG. 18. On the outer edge of the cassette profile are two positioning ribs and three fixation ribs. The purpose of the positioning ribs is to prevent the cassette turning in a radial direction when inserted in the printer. The purpose of the fixation ribs is to prevent axial movement of the cassette out of the printer once inserted.

The cassette-receiving bay is generally circular in cross-section, with a push plate at one end and open at the other end. The cassette is inserted downwards onto the push plate. An inner side of the cassette-receiving bay is formed of a locking ring. An inner surface of the locking ring has grooves for receiving the positioning ribs and fixation ribs of the cassette. A fixed part of the cassette-receiving bay is disposed behind the locking ring. In order to insert the cassette, the ribs and the grooves are aligned and the cassette is pushed downwards such that each rib slides along its respective groove. The push plate is moveable and is therefore pushed downwards as the cassette is inserted.

The locking ring includes an exit slit for the tape so that the tape can exit the cassette-receiving bay past the idler roller. The push plate is connected to the fixed part of the cassette receiving bay and the locking ring is spring loaded in a tangential direction by a spring. As a cassette is pushed into place, the spring urges the locking ring clockwise with respect to the fixed part of the cassette-receiving bay. However the ring cannot rotate under the action of the spring until the cassette is fully inserted. This is because during insertion the fixation ribs hold the grooves open. Rotation of the locking ring locks the cassette in position. When the locking mechanism is released, the push plate urges the cassette in an upward direction ejecting the cassette from the cassette-receiving bay.

SUMMARY OF THE INVENTION

The invention provides an improvement on the locking and ejecting mechanisms described above.

According to a first aspect the invention provides a label printer comprising a cassette-receiving bay, said cassette-receiving bay having a base, a top opening opposite the base, and a locking mechanism extending from said base, said locking mechanism having a locking part, said locking part being movable in a first direction and biased in a second direction opposite to said first direction, said locking part having one or more projections such that a force thereon directed towards said base causes the locking part to move in the first direction and wherein said locking part is biased to move in said second direction when the force is removed. In one arrangement, said locking mechanism is arranged whereby when a cassette is inserted into the cassette receiving bay, said locking part extend through an opening in a base of the cassette.

According to a second aspect of the present invention there is provided a label cassette comprising: a housing having a base and a top; an opening in the base; and a locking member positioned inside the housing, said locking member having one or more projections extending over said opening for cooperation with a locking mechanism in a label printer to lock the cassette in the label printer.

According to a third aspect the invention provides a label printer comprising a cassette-receiving bay, said cassette-receiving bay having a base, a top opening opposite the base, and a locking mechanism comprising two locking elements extending into the cassette-receiving bay for locking a cassette in the cassette-receiving bay, wherein each locking element is moveable between a locking position and an unlocked position, the two locking elements being linked by an actuator mechanism positioned below the base of the cassette-receiving bay so as to synchronise movement of the two locking elements.

Such an arrangement provides an improvement over the previously described locking ring arrangement in that the lever mechanism does not take up space around the cassette-receiving bay.

Preferably, the locking mechanism comprises an actuating button linked to the lever mechanism for manually operating the locking mechanism for releasing a cassette inserted into the cassette-receiving bay. Alternatively, the locking mechanism may comprise an electrical actuating mechanism linked to the lever mechanism for electrically operating the locking mechanism for locking and releasing a cassette inserted into the cassette-receiving bay. The electrical actuating mechanism may be operated by pressing a button on the label printer.

Preferably, the two locking elements are spaced apart in the cassette receiving bay. More preferably, the cassette-receiving bay comprises side walls extending between the base and the top opening, and each of the two locking elements are positioned adjacent different side walls relative to each other. Most preferably, the two locking elements are positioned adjacent opposite side walls relative to each other.

Spacing the locking elements apart in this manner allows a cassette to be more firmly held within the cassette-receiving bay and minimizes movement of the cassette within the cassette-receiving bay.

Preferably, each locking element is biased towards the locking position.

Insertion of a cassette into the cassette-receiving bay causes the locking elements to move into the unlocked position and the locking elements are biased towards the locking position to lock the cassette in place when fully inserted.

Preferably, each locking element is arranged to be movable through a corresponding opening in a side wall of the cassette-receiving bay whereby in the locking position each locking element is positioned within the corresponding opening in the side wall of the cassette-receiving bay.

This arrangement saves space in the cassette receiving bay and allows for a more compact label printer design.

Preferably, each locking element comprises a projection arranged whereby a force thereon directed toward said base causes the locking element to move from the locking position to the unlocked position and wherein said locking elements are biased to return to the locking position when the force is removed from the projection.

Preferably, each locking element comprises an elongate element extending in a direction from said base to said top opening and having the projection at a top opening end thereof extending towards a central portion of the cassette-receiving bay.

Preferably, each projection has a sloped upper surface for cooperating with a cassette inserted into the cassette-receiving bay for moving the locking element from the locking position to the unlocked position.

Preferably, each projection is arranged to extend into the cassette-receiving bay through the corresponding opening in the side wall of the cassette-receiving bay.

With the aforementioned arrangement, only the projections of the locking mechanism need extend into the cassette-receiving bay. Such an arrangement saves space in the cassette-receiving bay and allows for a more compact label printer design.

Preferably, the actuator mechanism comprises a lever mechanism.

Preferably, the lever mechanism comprises an actuating bar and the two locking elements are rotationally coupled to the actuating bar for rotating in opposite directions on actuation of the lever mechanism.

This arrangement provides a simple mechanism for synchronizing the movement of the locking elements in opposite directions for locking and releasing a cassette in the cassette receiving bay. movement of the locking elements in opposite directions for locking and releasing a cassette in the cassette receiving bay.

Preferably, the locking mechanism comprises a biasing means for biasing the locking elements towards the locking position.

Preferably, the biasing means is arranged to act on the actuating bar.

With the aforementioned arrangement, both locking elements are biased by a single biasing means via the actuating bar so as to better synchronize their movement.

Preferably, each of the locking elements is coupled to the actuating bar by a respective coupling member extending in a perpendicular direction relative to the locking element.

Preferably, the locking elements have respective centers of rotation on opposite sides of the actuating bar to each other. However, if the locking elements are positioned on opposite sides of the actuating bar then they may have respective centers of rotation on the same side of the actuating bar.

Preferably, wherein the coupling between the actuating bar and the locking elements is adapted to allow the locking elements to move in a rotational direction while the actuating bar is moved in a linear direction.

Preferably, the actuating bar has a portion extending substantially parallel with the base of the cassette-receiving bay and a portion extending substantially perpendicular to the base, the locking elements being coupled to the parallel portion and the actuating button being coupled to an end of the perpendicular portion.

The aforementioned arrangement provides a simple arrangement for allowing a cassette to be locked and released by the linear actuation of a button on the label printer.

In another embodiment the locking mechanism comprises more than two locking elements.

According to a fourth aspect, the invention provides a label printer comprising a cassette-receiving bay, said cassette-receiving bay having a base, a top opening opposite the base, and side walls extending between the base and the top opening, the label printer further comprising one or more ejector mechanisms, each ejector mechanism comprising an ejecting element extending from a side wall into the cassette-receiving bay, the ejector element being movable in a direction towards the base by a cassette inserted into the cassette-receiving bay and biased in a direction towards the top opening for ejecting a cassette, wherein the ejecting element extends from the side wall part way into the cassette-receiving bay and has a free end unconnected to any other structural elements of the label printer.

Such an arrangement negates the requirement for a push plate which may catch on the various printer mechanisms extending from the base of the cassette-receiving bay. Accordingly, this arrangement provides an improvement over the previously described arrangement.

Preferably, the ejector element is an elongate element extending in a perpendicular direction relative to the side wall.

Preferably, the ejecting element extends through an opening in the side wall of the cassette-receiving bay.

Preferably, the opening in the side wall is an elongate slit.

With the aforementioned arrangement, only the ejecting elements of the ejector mechanisms need extend into the cassette-receiving bay. Such an arrangement saves space in the cassette-receiving bay and allows for a more compact label printer design.

Preferably, each ejector mechanism comprises a biasing mechanism, the ejecting element being coupled to the biasing mechanism whereby the ejector element is movable in the direction towards the base and the biasing mechanism biases the ejecting element in the direction towards the top opening for ejecting a cassette.

Preferably, the biasing mechanism is disposed on an opposite side of the side wall to the cassette-receiving bay, the ejecting element extending from the biasing mechanism through the opening in the side wall.

Again, such an arrangement saves space in the cassette-receiving bay and allows for a more compact label printer design.

Preferably, the biasing mechanism comprises an elongate guide member for guiding the ejecting element, the ejecting element being biased for movement along the guide member.

Such an arrangement results in a highly directed force being applied to a cassette on ejection to prevent rotation of the cassette which could result in the cassette catching on elements of the label printer within the cassette-receiving bay.

Preferably, the elongate guide member comprises a housing having a first elongate slit through which the ejecting element extends.

Such a housing aids in preventing dust clogging the guide and also prevents the ejecting element from catching on surrounding elements of the label printer.

Preferably, the housing comprises a second elongate slit through which a biasing member extends, the biasing member being coupled to the ejecting element within the housing and coupled to a biasing element outside the housing for biasing the ejecting element.

In an alternate arrangement, the biasing element may be provided within the housing.

Preferably, two ejector mechanisms are provided each adjacent a different side wall of the cassette-receiving bay. More preferably still, the two ejector mechanisms are disposed adjacent opposite side walls.

Such an arrangement results in a balanced force being applied to a cassette on ejection to prevent rotation of the cassette which could result in the cassette catching on elements of the label printer within the cassette-receiving bay.

Preferably, the label printer comprises both the locking and ejecting mechanisms described herein.

Preferably, a side wall of the cassette-receiving bay has a portion projecting into the cassette-receiving bay forming a guide for a corresponding recess in a cassette when inserted into the cassette-receiving bay.

Such an arrangement aids in guiding a cassette into and out of the cassette-receiving bay and aids in positioning the cassette relative to the locking and ejecting mechanisms.

Preferably, one of the locking elements extends from said guide thereby forming a combined guiding and locking arrangement.

This arrangement allows for highly precise positioning of the cassette in the cassette receiving bay. Furthermore, combining the guiding and locking elements saves space allowing for a more compact label printer design.

According to a fifth aspect the invention provides a label cassette for use with a label printer as described herein, the label cassette comprising: a housing having a base, a top, and sides extending from said base to said top; wherein a recess is provided in a side of the housing extending from the base to the top and wherein a first locking element is provided in said recess for interaction with one of the locking elements extending into the cassette-receiving bay of the label printer for locking the cassette in the cassette-receiving bay of the label printer when the cassette is inserted into the cassette-receiving bay of the label printer.

By providing the locking element in a recess of the cassette housing, the locking element does not protrude from the cassette housing. This is advantageous as otherwise an increase in the size of the cassette-receiving bay or a reduction in the size of the cassette would be required. The present arrangement thus makes more efficient use of the space available.

Such an arrangement may also aid in guiding a cassette into and out of the cassette-receiving bay and aid in positioning the cassette relative to the locking mechanism of the label printer. This arrangement allows for highly precise positioning of the cassette in the cassette-receiving bay. Furthermore, combining the guiding and locking elements of the cassette saves space allowing for a more compact cassette design.

Preferably, the locking element comprises a rib extending across said recess.

Preferably, a second locking element is provided on an opposing side wall of the cassette housing to the side wall having the recess.

Preferably, a second locking element is provided on an opposing side wall of the cassette housing to the side wall having the recess The provision of locking elements on opposing side walls of the cassette housing allows a cassette to be more firmly held within the cassette-receiving bay and minimizes movement of the cassette within the cassette-receiving bay.

Preferably, the second locking element of the cassette comprises an opening in the opposing side wall. With this arrangement, the base and side wall of the cassette push the locking element of the label printer into the unlocked position and the biasing means moves the locking element of the label printer into the opening to lock the cassette in the cassette-receiving bay. The provision of an opening rather than a rib allows a more compact design of cassette and label printer. It should be noted that the rib on the opposing side does not compromise the compactness of the cassette and label printer as it is positioned in the guiding recess.

According to a sixth aspect the invention provides a label cassette for use with a label printer as described herein, the label cassette comprising a housing having a base, a top, and sides extending from said base to said top, wherein a locking element is provided on a side of the housing comprising an upper portion extending parallel to the base and a lower portion extending in a direction perpendicular to the upper portion from the upper portion towards the base, the lower portion having a surface which slopes outwards from the side of the housing towards the upper portion, the lower portion being narrower than the upper portion as viewed from a direction perpendicular to the side of the housing. The locking element is hereinafter referred to as being T-shaped in light of it's shape as viewed from a direction perpendicular to the side of the housing on which the locking element is disposed.

The T-shaped locking element is an improvement over previous locking elements which have a sloped lower surface and a flat upper surface in that the contact area of the sloped surface of the T-shaped locking element is reduced in comparison to other wedge shaped elements. As a result, friction between the sloped surface and the corresponding locking element in a printer is reduced on insertion of the cassette into the printer. This effect is achieved by providing a sloped surface which is narrower than the flat upper surface thus resulting in the T-shaped locking element of the present invention.

According to a seventh aspect the invention provides a set of label cassettes as described herein, the set comprising label cassettes of differing widths as measured from the base to the top, wherein a ratio of a distance between the base and the first locking element and a distance between the first locking element and the top increases on decreasing width.

This arrangement allows for label cassettes of differing width to be positioned and locked in the correct printing position in a label printer.

Preferably, a ratio of a distance between the base and the second locking element and a distance between the second locking element and the top increases on decreasing width.

Preferably, the label cassette having a smallest width has the second locking mechanism provided by the top of the label cassette.

This arrangement allows a cassette to be more firmly held within the cassette-receiving bay and minimizes movement of the cassette within the cassette-receiving bay. The use of the top of the cassette as the locking mechanism for the smallest cassette maximizes the range of thickness of cassette in the set.

According to an eighth aspect, the invention provides a printing system comprising a label printer as described herein and a label cassette. Preferably, the cassette has one or more locking features for cooperating with the locking elements of the label printer.

According to a ninth aspect, the invention provides a label printer comprising a cassette-receiving bay, said cassette-receiving bay having a base, a top opening opposite the base, and a locking mechanism comprising one or more locking elements extending into the cassette-receiving bay for locking a cassette in the cassette-receiving bay, wherein each locking element is moveable between a locking position and an unlocked position and wherein each locking element is arranged to be movable through a corresponding opening in a side wall of the cassette-receiving bay whereby in the locking position each locking element extends into the cassette-receiving bay and in the unlocked position each locking element is positioned within the corresponding opening in the side wall of the cassette-receiving bay.

BRIEF DESCRIPTION OF THE DRAWINGS

For a better understanding of the invention and to show how the same may be carried into effect, reference will now be made by way of example to the accompanying drawings in which.

DETAILED DESCRIPTION

Figure 1:
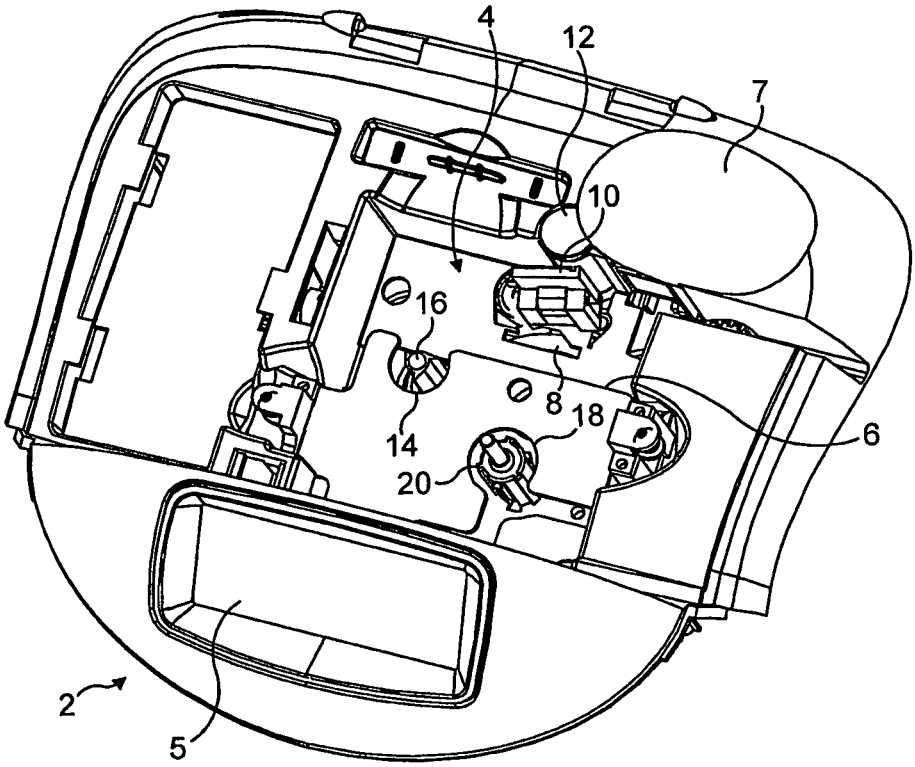
FIG. 1 is a top view of a label printer with a lid of the printer removed to show a cassette-receiving bay.

FIG. 1 shows a top view of a label printer 2 with a lid of the label printer removed to show a cassette-receiving bay 4. The label printer comprises a display 5, a cutter 7 and may also comprise a keyboard (not shown). The cassette-receiving bay 4 is substantially square in cross-section having a base and sidewalls extending from the base to an opening for receiving a cassette therein. A spring biased ejector plate 6 is mounted between the base and the opening of the cassette receiving bay 4. The ejector plate 6 is movable in a downward direction (towards the cassette receiving bay base) and is biased in an upward direction (towards the cassette receiving bay opening) for ejecting a cassette. The ejector plate 6 has an opening 8 therein for receiving a printhead 10 which cooperates with a platen 12 in the conventional manner. The ejector plate 6 has a further opening 14 therein for receiving a sprocket 16 for cooperation with an ink ribbon spool of a cassette. This ink ribbon spool can be omitted when the image receiving medium in the cassette is direct thermal material. The ejector plate 6 also has a further opening 18 for receiving a locking mechanism 20 for locking a cassette within the cassette-receiving bay 4.

Figure 2:
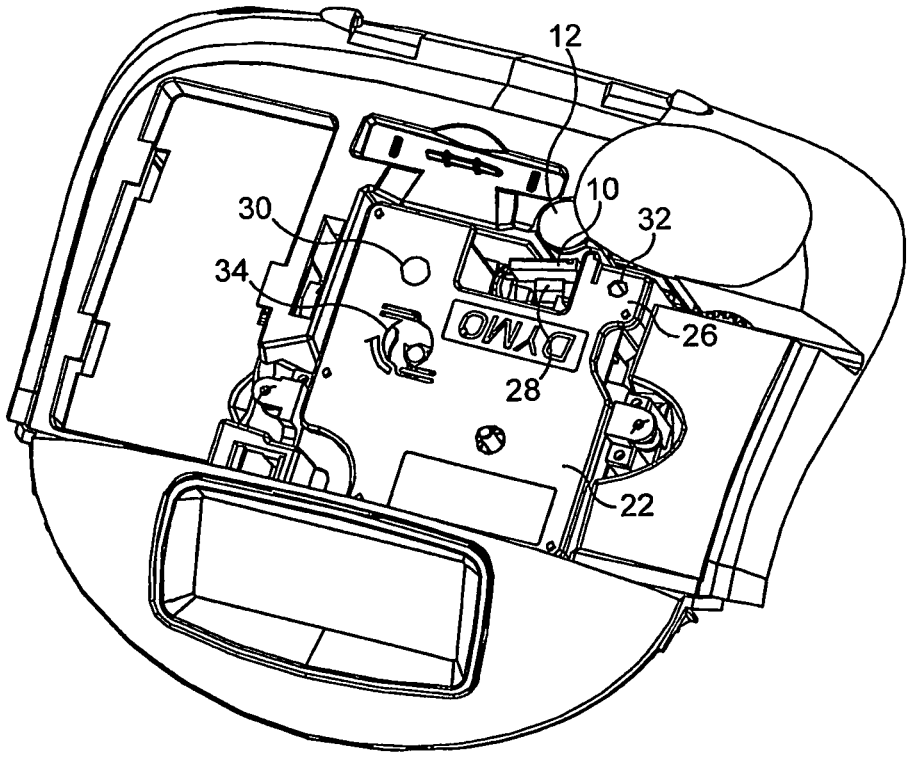
FIG. 2 is a top view of the label printer of FIG. 1 with a 24 mm tape cassette received therein.

FIG. 2 shows a top view of the label printer of FIG. 1 with a 24 mm tape cassette 22 received therein. The cassette 22 comprises a housing having a recess 26 therein for receiving the printhead 10 when the cassette 22 is mounted in the cassette-receiving bay 4. In an alternate arrangement, the platen 12 is received in the recess 26. An opening 28 is provided on a side of the tape cassette 22 across which tape passes for cooperation with the printhead 10 and platen 12 in the conventional manner. The cassette comprises an ink ribbon supply spool 30 and an ink ribbon take-up spool 34. A hole 32 is provided in the cassette for receiving a positioning pin. A tape supply spool (not shown) is also housed within the cassette housing around the locking core. The ink ribbon passes in cooperation with the image receiving medium (e.g. a tape or die cut labels) across the opening 28 for printing. The locking mechanism 20 is provided for locking the cassette in the correct position within the cassette-receiving bay for printing.

Figure 3:
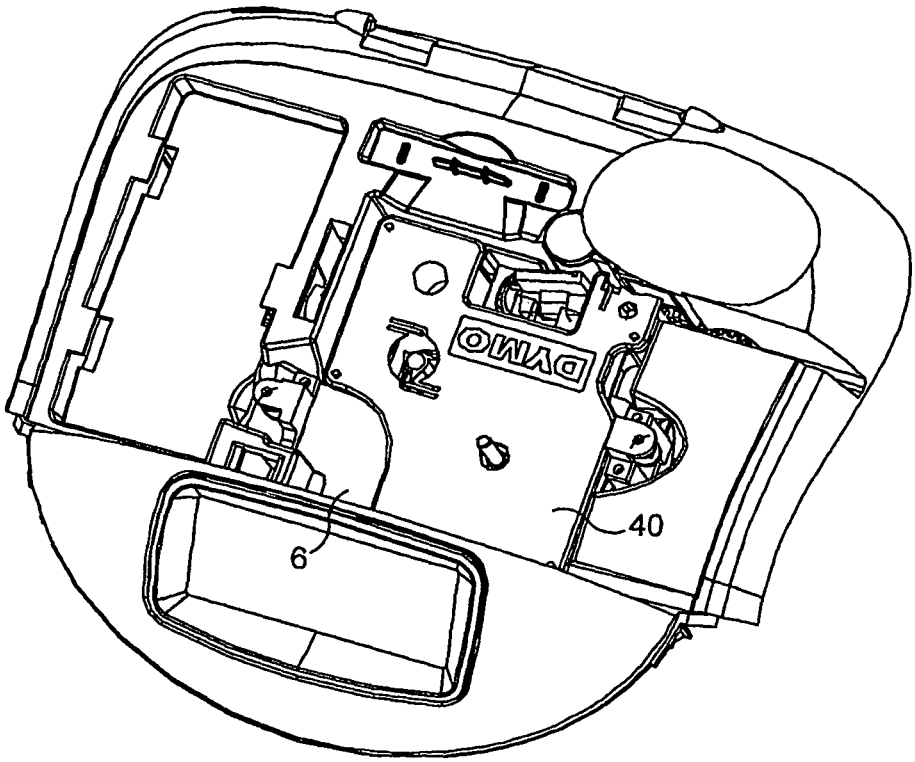
FIG. 3 is a top view of the label printer of FIGS. 1 and 2 with a 12 mm tape cassette received therein.

FIG. 3 shows a top view of the label printer of FIGS. 1 and 2 with a 12 mm tape cassette 40 received therein. As the ejector plate 6 extends over substantially all the cassette receiving bay area, the ejector plate 6 can act on cassettes of varying sizes and shapes. Of course, if the cassette has spools (not necessary in the case of direct thermal image receiving medium), the spools should be in the correct locations for cooperation with sprockets extending from the base of the cassette-receiving bay.

FIG. 3 shows a top vie of the label printer of FIGS. 1 and 2 with a 12 mm tape cassette 40 received therein. S the ejector plate 6 extends over substantially all the cassette receiving bay area, the ejector plate 6 can act on cassettes of varying sizes and shapes. Of course, if the cassette has spools (not necessary in the case of direct thermal image receiving medium). The spools should be in the correct locations for cooperation with sprockets extending from the base of the cassette-receiving bay.

Figure 4:
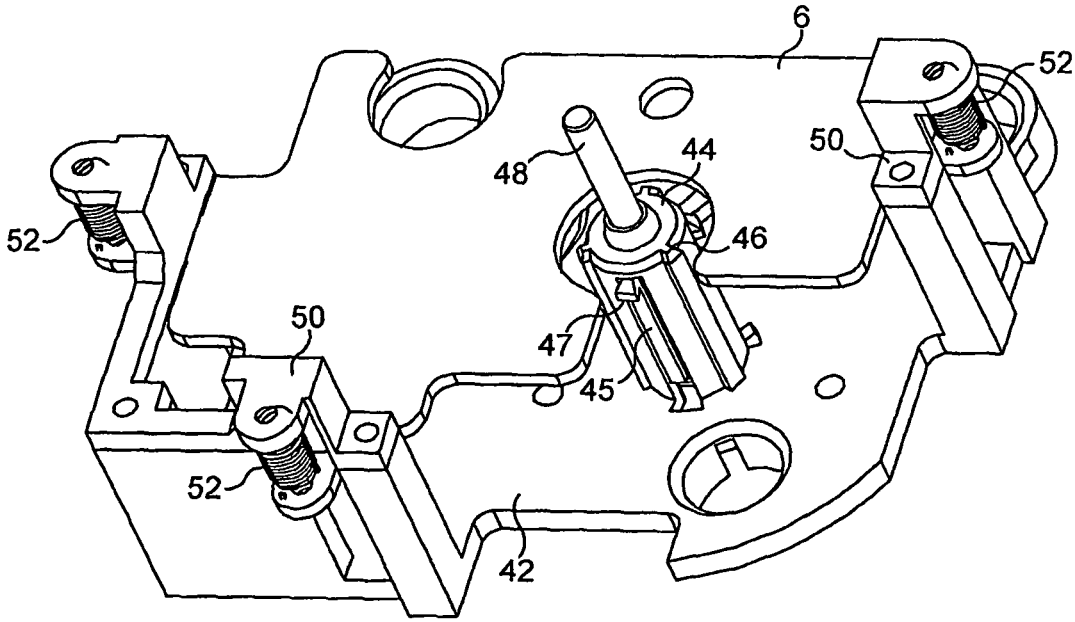
FIG. 4 is a top perspective view of the cassette-receiving bay.

FIG. 4 shows a top perspective view of the cassette-receiving bay 4 in more detail. The cassette receiving bay 4 comprises a base plate 42 on which the locking mechanism is mounted. The locking mechanism comprises a cylindrical fixed part 44 integrated in the base of the cassette receiving bay, having elongate guide ribs 46 extending in a longitudinal direction on the surface of the cylindrical fixed part 44 for alignment of a cassette. A locking part 45 is rotatably assembled in the fixed part 44. The locking part 45 has projections 47 extending therefrom for cooperating with a cassette to lock the cassette in position. An elongate knob 48 is axially movable relative to the locking part 45.

Three support members 50 extend from the base plate 42. Springs 52 are attached to the support members 50 from which the ejector plate 6 is mounted.

Figure 5:
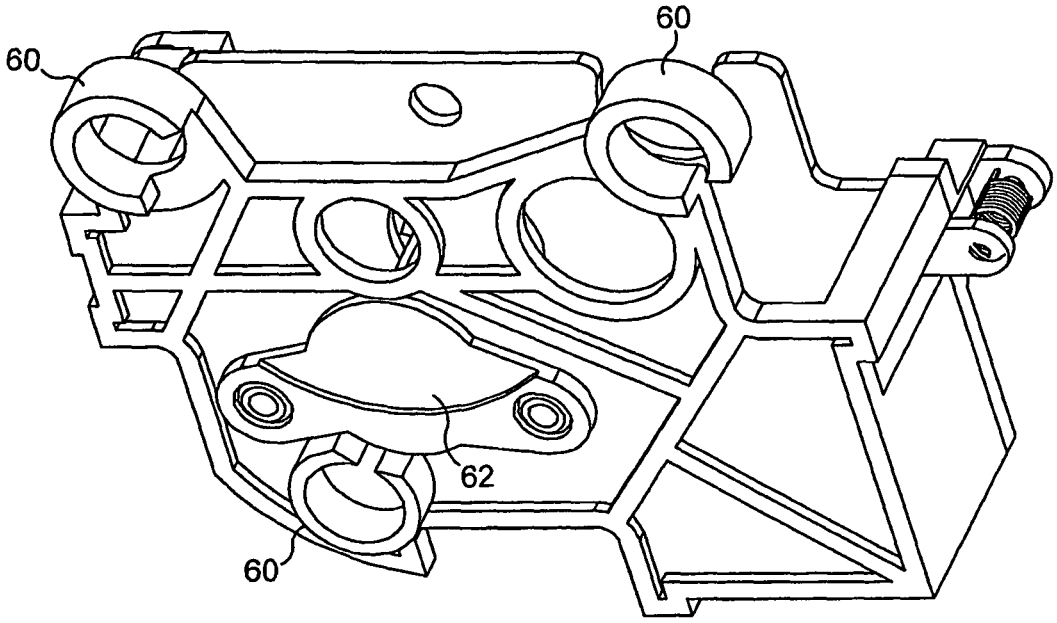
FIG. 5 is a bottom perspective view of the cassette-receiving bay.

FIG. 5 shows a bottom perspective view of the cassette-receiving bay. Fixation points 60 are provided for fixing the cassette-receiving bay to the label printer. An attachment cover 62 is also illustrated for supporting the locking mechanism and attaching the mechanism to the base plate 42. The cassette receiving bay, including the fixed part of the locking mechanism, may be integral with a larger base part of the label printer.

Figure 6:
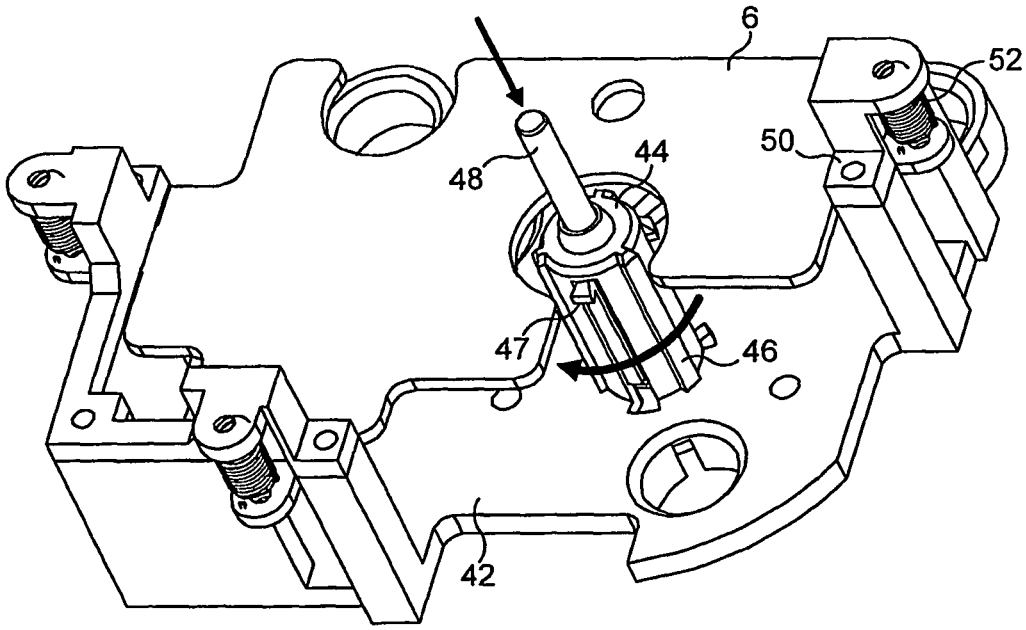
FIG. 6 shows a top perspective view of the cassette-receiving bay illustrating actuation of a locking mechanism to disengage the locking mechanism.

FIG. 6 shows a top perspective view of the cassette-receiving bay illustrating actuation of the elongate knob 48 to disengage the locking mechanism. Actuation of the elongate knob 48 in a direction parallel to the direction of insertion of a cassette causes the locking part 45 to rotate in a clock-wise direction. The locking part 45 is typically rotated through approximately a 10° angle. This rotation disengages the locking mechanism. The locking part is spring biased in an anti-clockwise direction such that when the knob 48 is released, the locking part rotates in an anti-clockwise direction.

A more detailed description of the locking and ejection mechanisms is given below with reference to FIGS. 7 to 22.

Figure 7:
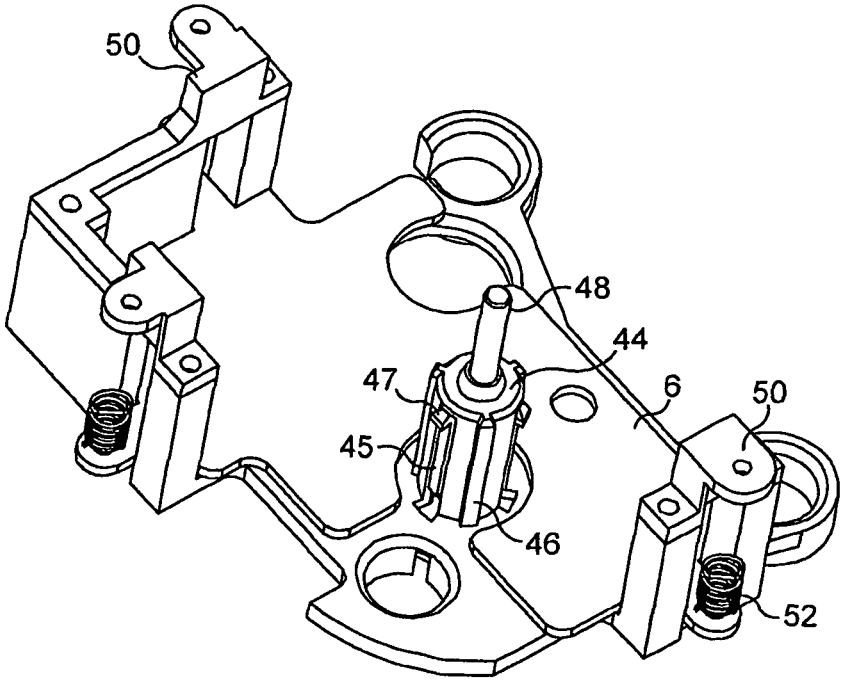
FIG. 7 is a top perspective view of a cassette-receiving bay.
Figure 8:
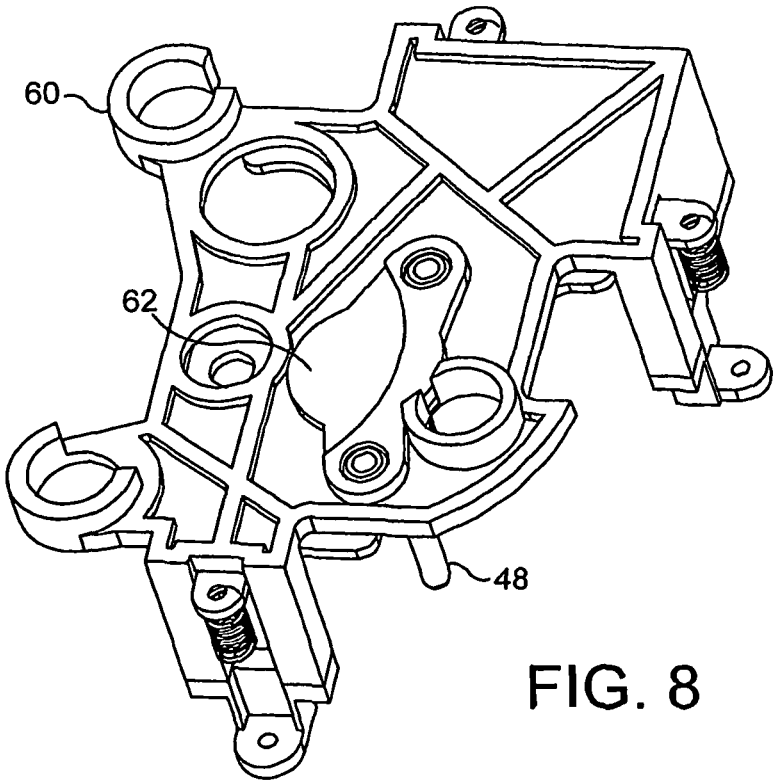
FIG. 8 is a bottom perspective view of the cassette-receiving bay.

FIG. 7 is a top perspective view of a cassette-receiving bay with the ejector plate/push plate not yet attached to support members 50 via the springs 52. The locking mechanism is visible comprising a fixed part having elongate guide ribs 46 and a rotatable locking part 45 having projections 47. FIG. 8 is a bottom perspective view of the cassette-receiving bay illustrating a base plate 62 and fixation points 60 as previously mentioned.

Figure 9:
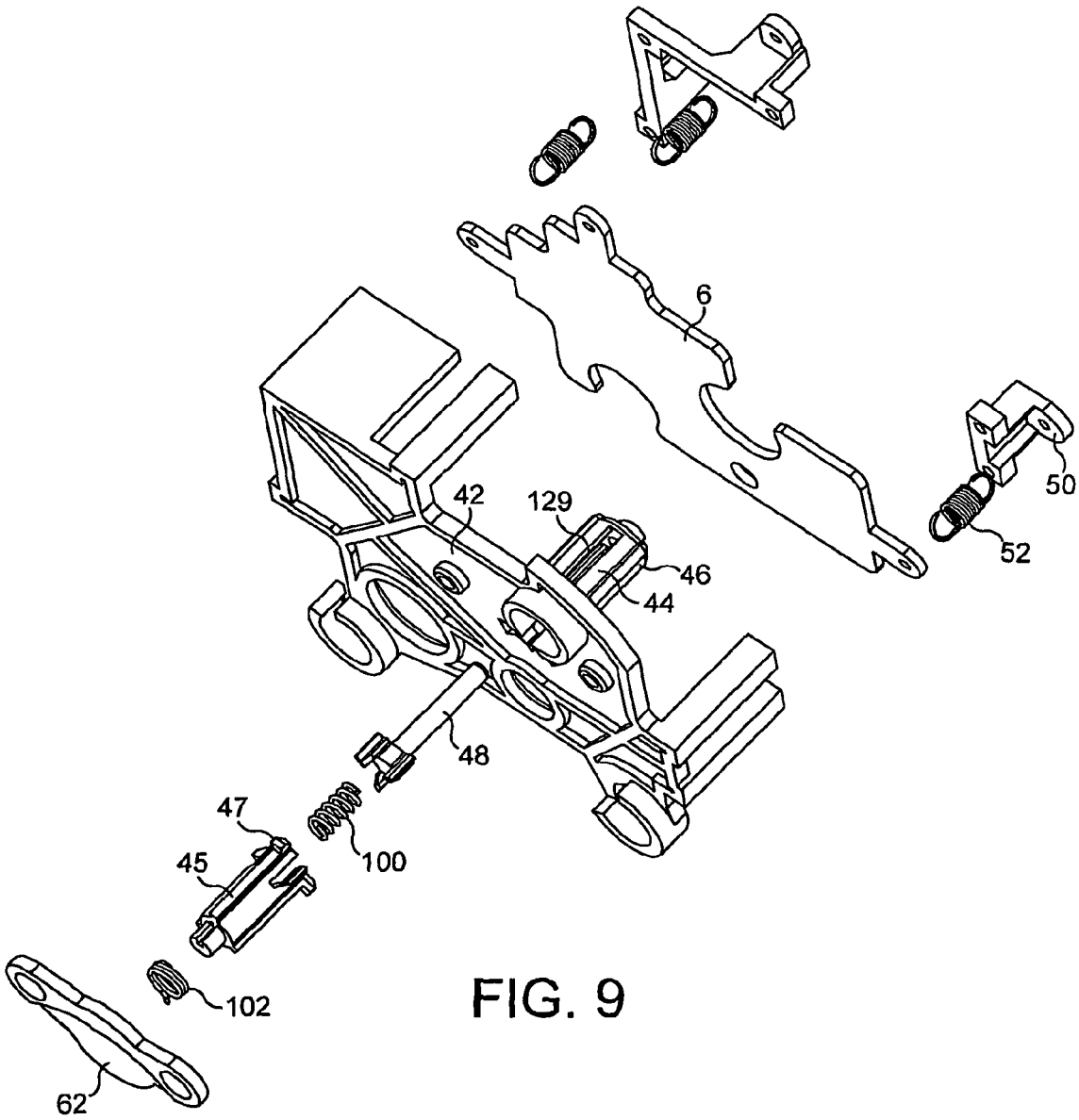
FIG. 9 shows an exploded view of the cassette-receiving bay.

FIG. 9 shows an exploded view of the cassette-receiving bay. The fixed part 44 of the locking mechanism is integral with the base plate 42 and is cylindrical in shape having guide ribs 46 on an outer surface thereof. The fixed part also has elongate openings through which projections 47 of the locking part can protrude when the locking part is mounted in the fixed part 44. In constructing the locking mechanism, the following sequential steps are performed: an ejector button comprising the previously mentioned elongate knob 48 is mounted in the fixed part 44; a compression spring 100 is mounted in the fixed part 44 against one end of the ejector button; a locking part 45 having projections 47 is mounted in the fixed part 44 with the compression spring 100 being disposed between the ejector button and the locking part 45; a torsion spring 102 is mounted in the fixed part 44 with one end fixed to the locking part and another end fixed to the fixed part 44; and a cover 62 is mounted to the base plate 42 so as to seal the afore-mentioned elements in the fixed part 44.

The ejector plate is mounted to the base plate via support members 50 and springs 52.

Figure 10:
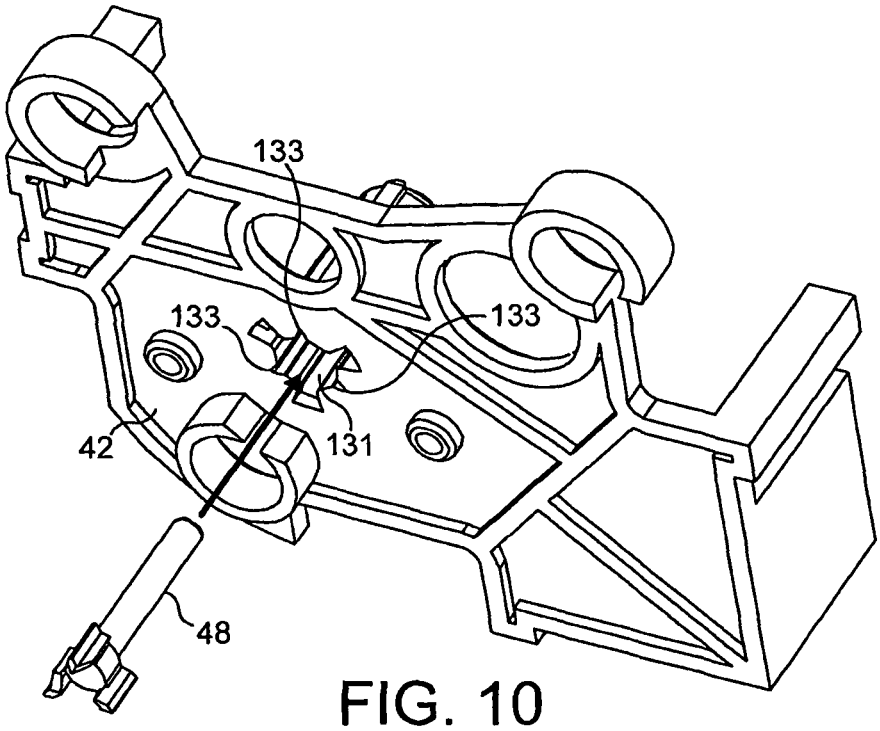
FIG. 10 illustrates an eject-button being assembled in the base of the cassette-receiving bay.
Figure 11:
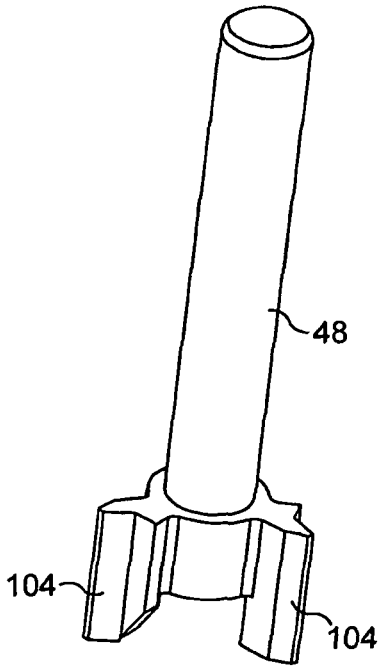
FIG. 11 shows the eject-button in more detail.

FIG. 10 illustrates the eject-button being assembled through an opening 131 in the base of the cassette-receiving bay. The ejector button comprises an elongate knob or shaft 48 and projections 104 as shown in FIG. 11 which cooperate with surfaces on the locking part 45 so as to rotate the locking part into an unlocked position when the elongate knob 48 is depressed. To aid in aligning the ejector button correctly relative to the locking part, guiding features 133 are provided on an interior surface of the fixed part 44 which correspond to the projections 104 of the ejector button.

Figure 12:
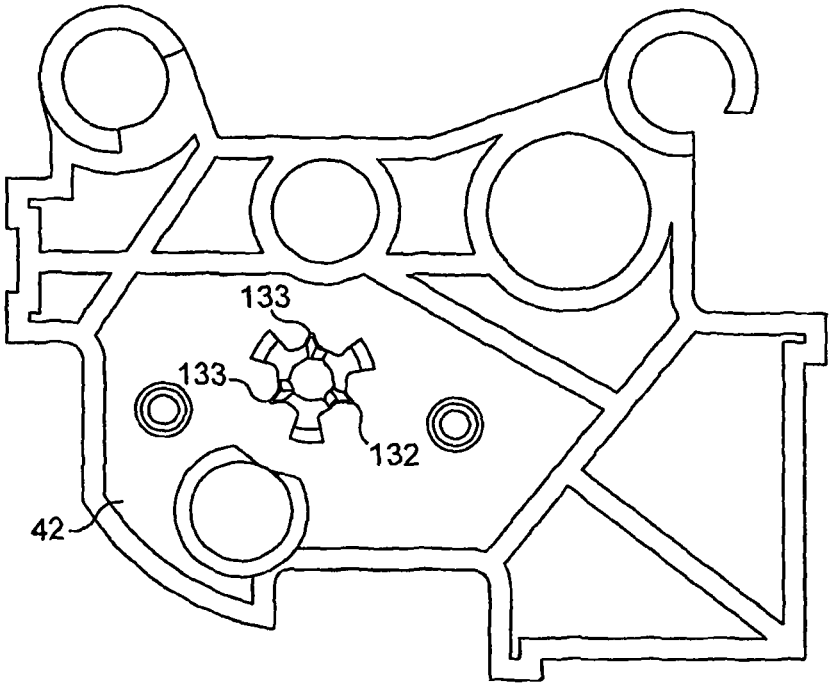
FIG. 12 illustrates the eject-button assemble in the base.
Figure 13:
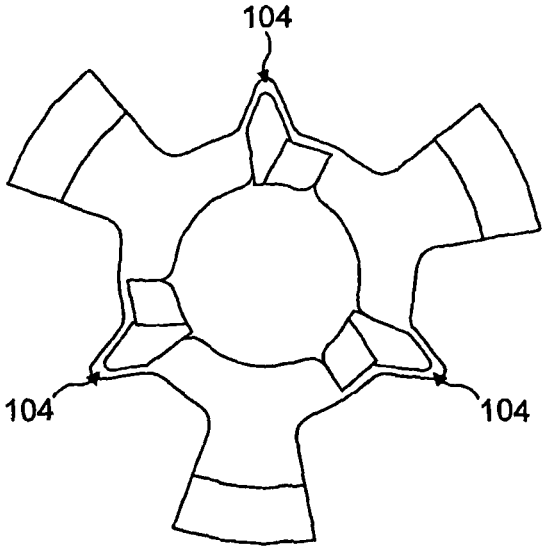
FIG. 13 illustrates guiding features of the eject-button in corresponding guiding grooves in the base.

FIGS. 12 and 13 illustrate the eject-button assemble in the fixed part with the projections 104 in the guiding features 133.

Figure 14:
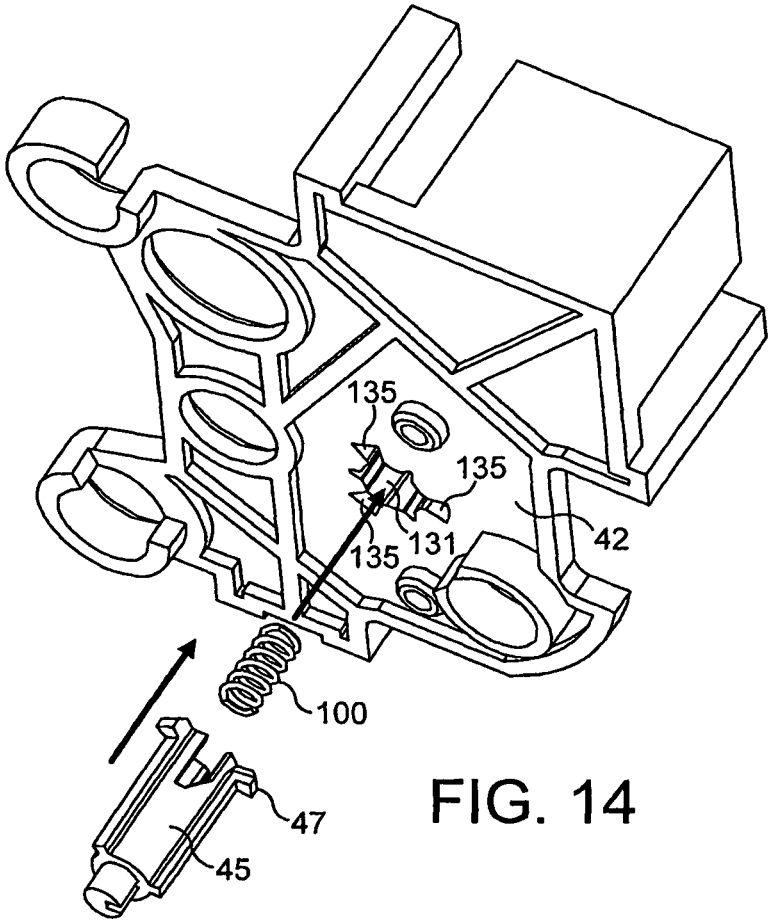
FIG. 14 illustrates a locking part and a compression spring being assembled in the base of the cassette-receiving bay.

FIG. 14 illustrates the locking part 45 and the compression spring 100 being assembled though the opening 131 in the base of the cassette-receiving bay. Guide features 135 in the fixed part correspond to the projections 47 of the locking part for alignment of the locking part. The guide features 135 also serve to limit the amount of rotational motion that the locking part can undergo when the locking part 45 is mounted in the fixed part 44. The projections 47 have sloped surfaces which interact with projections in a cassette to unlock the mechanism during insertion of a cassette. The sloped surfaces are at an angle between 0 and 90° relative to the base of the cassette-receiving bay. Preferably, the sloped surfaces are at an angle between 20 and 70° relative to the base of the cassette-receiving bay. More preferably still, the sloped surfaces are at an angle between 30 and 60° relative to the base of the cassette-receiving bay.

Figure 15:
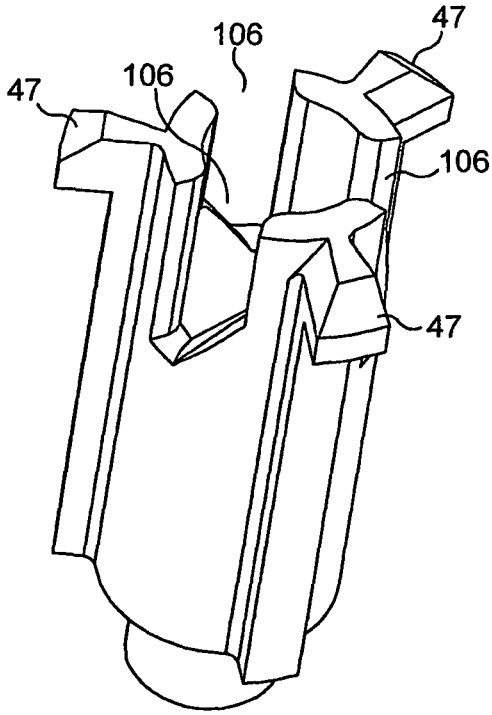
FIG. 15 shows the locking part in more detail illustrating locking and unlocking features.

FIG. 15 shows the locking part in more detail illustrating projections 47 which function as locking features and recesses 106 having sloped surfaces which function as unlocking features and interact with the projections 104 of the ejector button causing the locking mechanism to rotate when the ejector button is depressed. The sloped surfaces are at an angle between 0 and 90° relative to the base of the cassette-receiving bay. Preferably, the sloped surfaces are at an angle between 20 and 70° relative to the base of the cassette-receiving bay. More preferably still, the sloped surfaces are at an angle between 30 and 60° relative to the base of the cassette-receiving bay.

Figure 16:
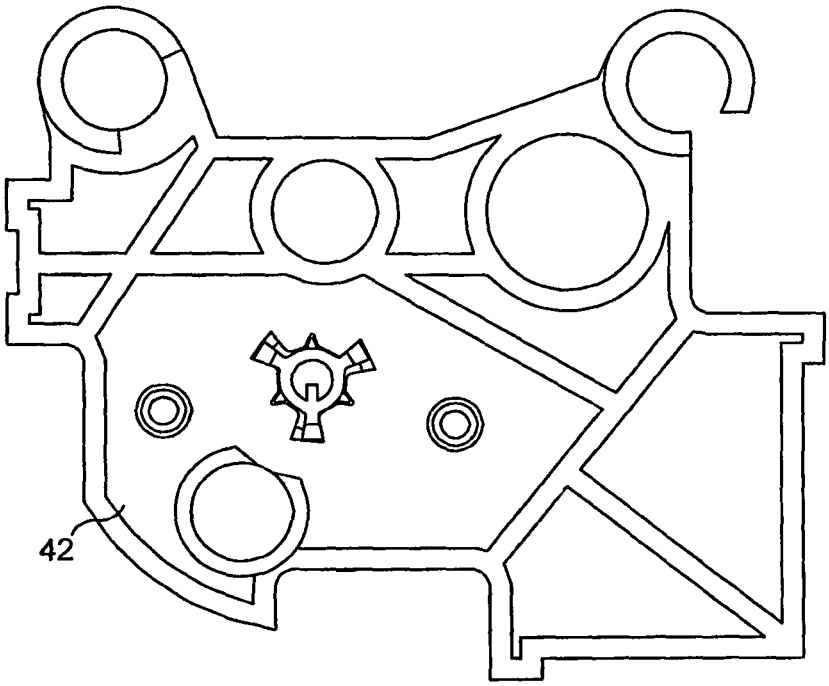
FIG. 16 illustrates how the locking features fit into corresponding openings in the base of the cassette-receiving bay.

FIG. 16 illustrates how the locking features 47 fit into corresponding openings 135 in the base of the cassette-receiving bay. The opening 135 are larger than the locking features 47 so as to allow the locking part 45 to rotate relative to the fixed part 44. 10° rotation is necessary to unlock the mechanism in one embodiment.

Figure 17:
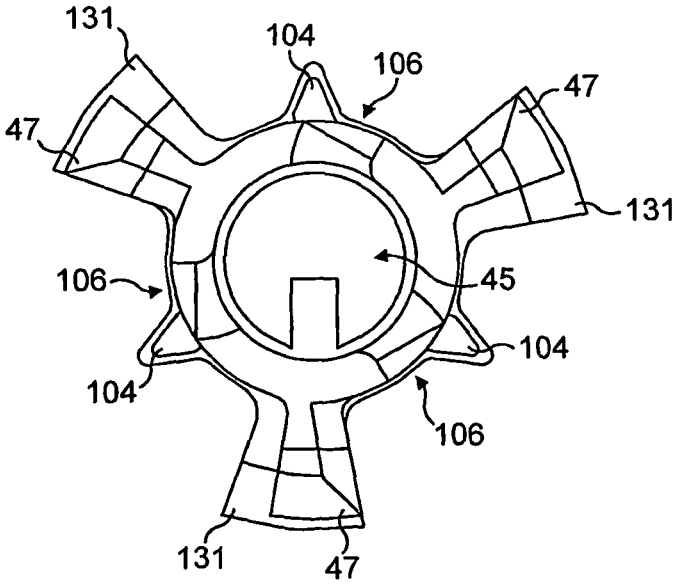
FIG. 17 illustrates the above-mentioned feature in more detail.

FIG. 17 illustrates the above-mentioned locking and unlocking features in more detail. The locking part 45 and the ejector button are mounted in the fixed part with the compression spring 100 there between. Projections 104 of the ejector button interact with surfaces 106 on the locking part to rotate the locking part causing projections 47 of the locking part to rotate in the openings 131.

Figure 18:
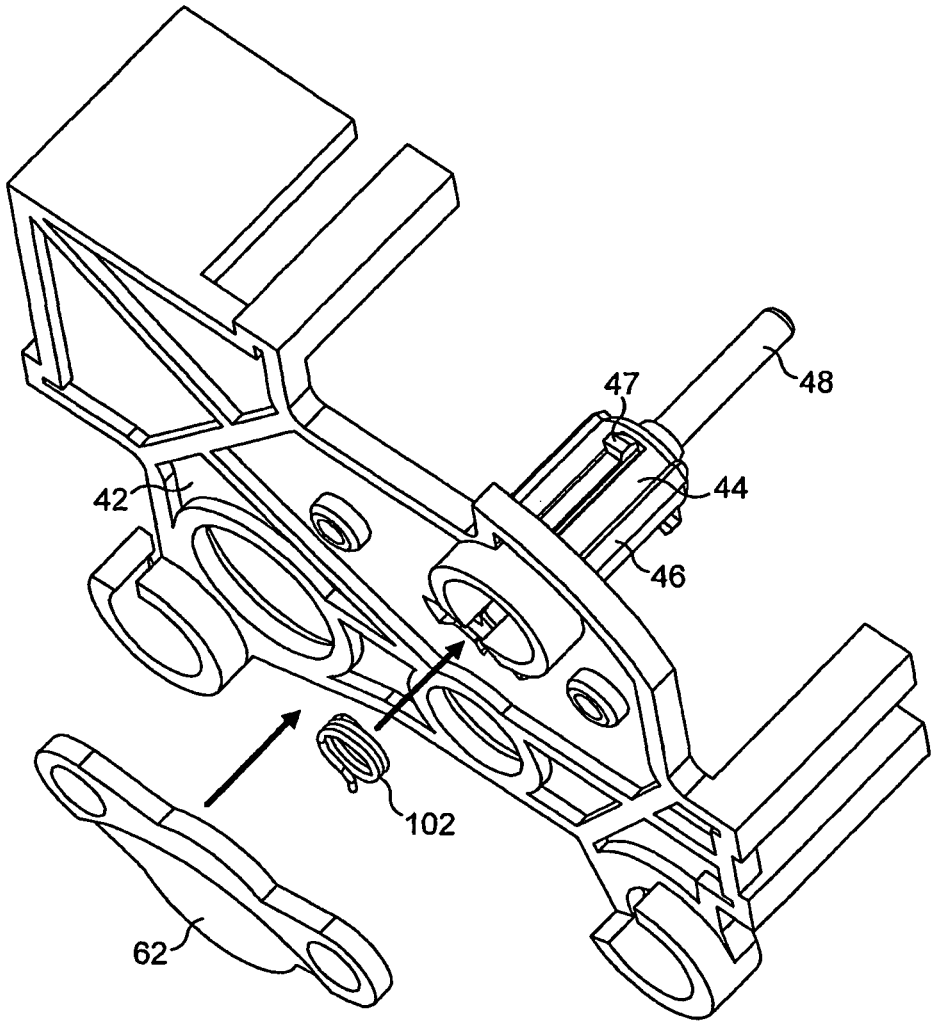
FIG. 18 illustrates a torsion spring assembly being mounted on the base of the cassette-receiving bay.

FIG. 18 illustrates the torsion spring 102 being mounted in the fixed part 44 and the cover 62 being mounted on the base plate 42.

Figure 19:
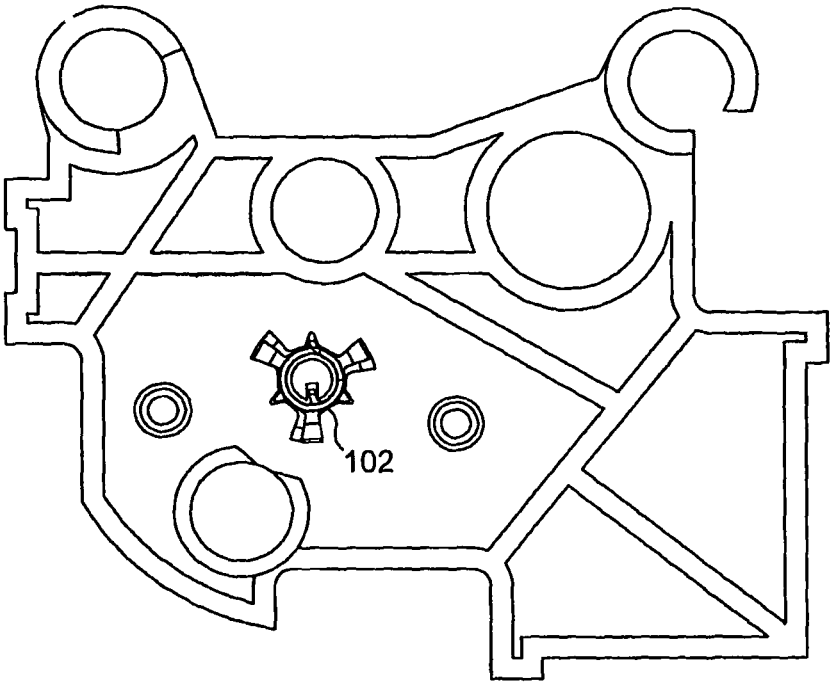
FIG. 19 illustrates the torsion spring mounted in the base of the cassette-receiving bay.
Figure 20:
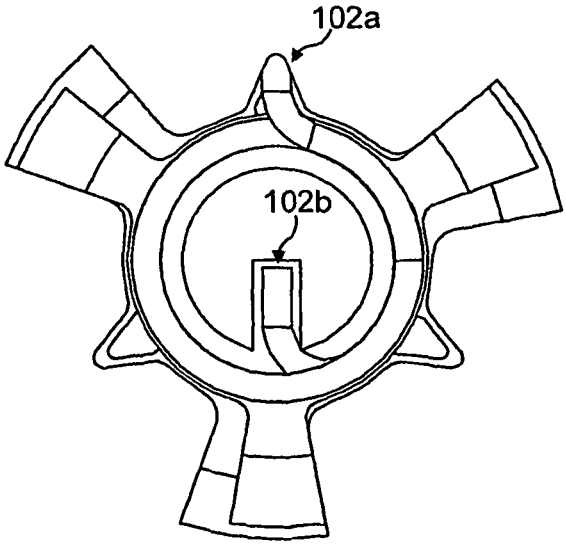
FIG. 20 illustrates the above-mentioned feature in more detail.

FIGS. 19 and 20 illustrate the torsion of the torsion spring is positioned in the locking part 45 for rotationally biasing the locking part 45 relative to the fixed part 44.

The compression spring 100 is disposed between the elongating knob 48 and the locking part 45 biasing the elongate knob in the upwards direction. The torsion spring 102 is assembled on an end of the locking part 45 in contact with the base 42 of the cassette receiving bay and on an end of the fixed part 44 to bias the locking part in a tangential direction, so that when the locking part 45 is rotated in a first direction, the torsion spring 102 biases the locking part 45 in a second direction.

The elongate knob 48 is movable in a downwards direction to rotate the locking part 45 in a first direction. When the elongating knob 48 is moved in a downwards direction, a ramp or sloped surface on the projections 104 of the ejector button cooperates with a ramp or a sloped surface 106 on the locking part 45 causing the locking part 45 to rotate in a first direction. When the elongate knob 48 is released, spring 100 moves the elongating knob in an upwards direction and spring 102 moves the locking part 45 in a second direction opposite to said first direction.

Figure 21:
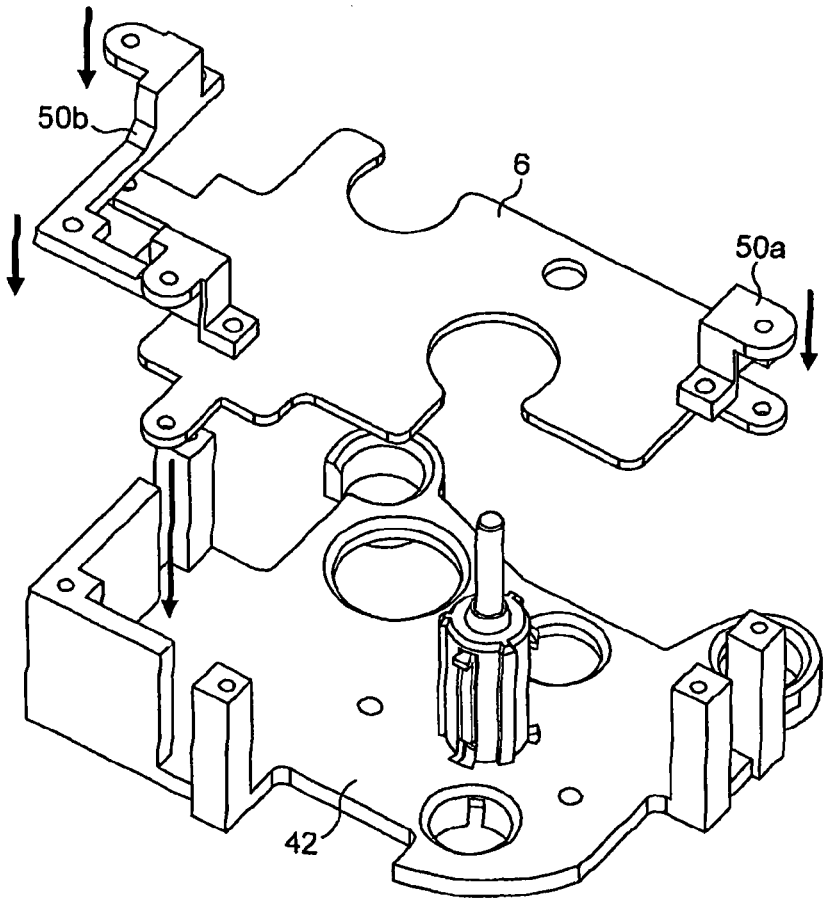
FIG. 21 illustrates a push-plate assembly being mounted in the cassette-receiving bay.
Figure 22:
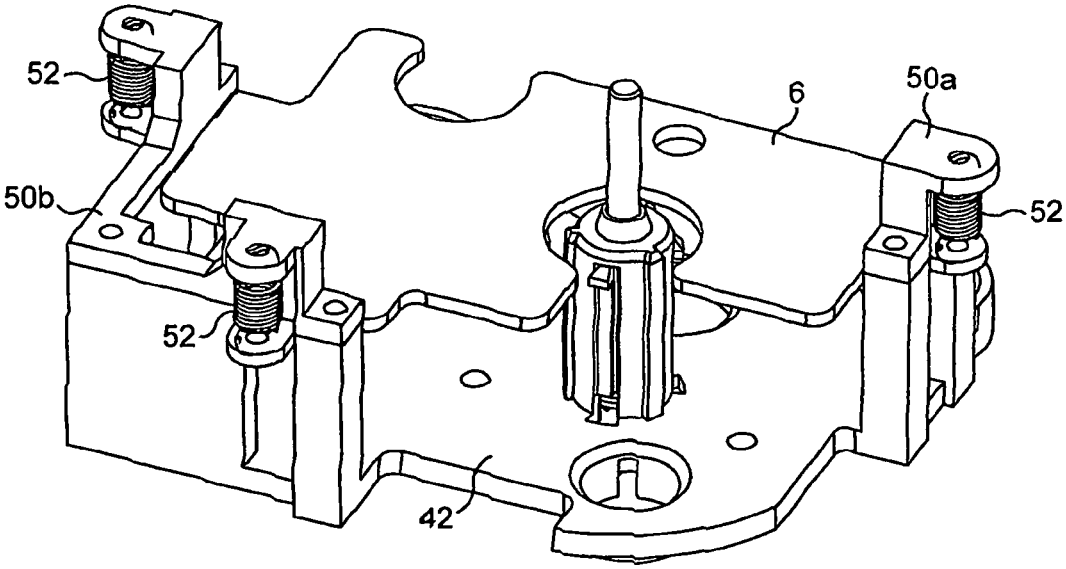
FIG. 22 illustrates the push-plate assembly mounted in the cassette-receiving bay.

FIGS. 21 and 22 illustrate the push-plate assembly being mounted to the base plate 42 in the cassette-receiving bay. The push plate 6 is mounted via supports 50*a*, 50*b* with springs 52.

Figure 23:
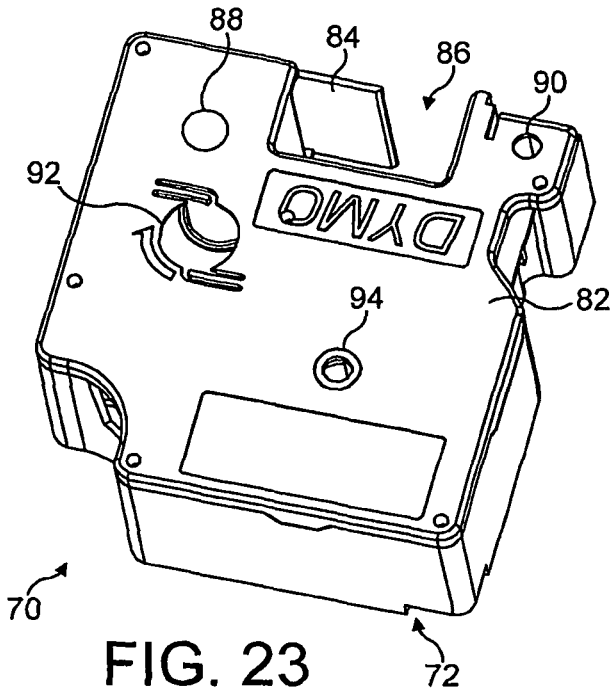
FIG. 23 shows a top perspective view of a tape cassette for use with the label printer of FIGS. 1 to 22.

FIG. 23 shows a top perspective view of a tape cassette for use with the label printer of FIGS. 1 to 22. The cassette 70 comprises a housing having a base 72 and a top 82. A recess 84 is provided in the housing for receiving a printhead or a platen when the cassette is mounted in a cassette-receiving bay. An opening 86 is provided on a side of the tape cassette across which tape passes for cooperation with a print head and a platen in the conventional manner. The cassette comprises an ink ribbon supply spool and an ink ribbon take-up spool 92. A hole 90 is provided for a positioning pin of the printer. A tape supply spool is also provided on a spool (not shown) around the locking mechanism. The ink ribbon passes in cooperation with the print receiving tape across the opening 86 for printing. An opening 94 is provided in the housing for receiving a locking mechanism. The opening 94 passes from the bottom to the top of the cassette housing. The tape may be a roll of die cut labels. In another embodiment, the material of the image receiving medium is direct thermal material and ink ribbon and ink ribbon spools are omitted.

Figure 24:
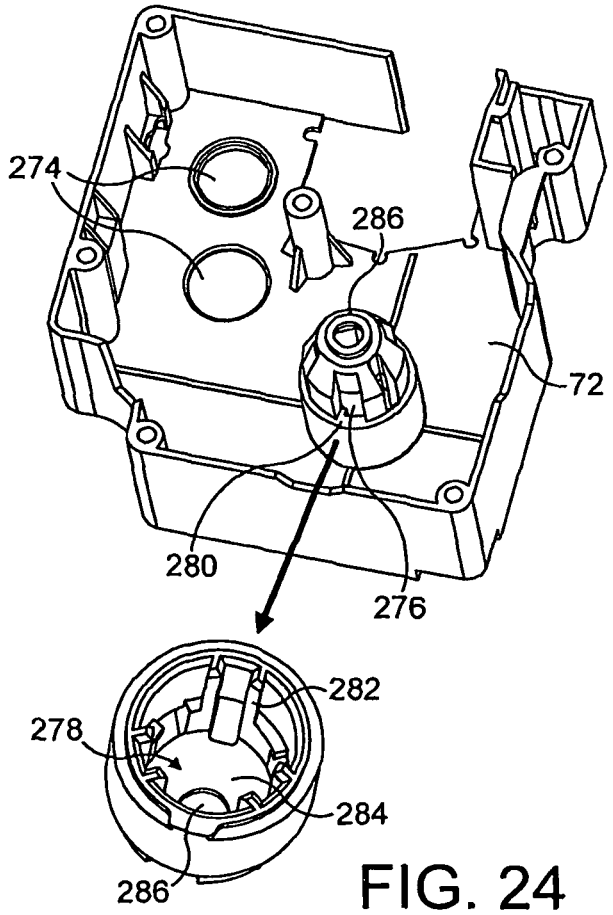
FIG. 24 shows a top perspective view of the tape cassette of FIG. 23 with a top side of the label cassette removed to show some of the interior structure of the cassette.

FIG. 24 shows a top perspective view of the tape cassette of FIG. 23 with the top side 82 of the tape cassette removed to show some of the interior structure of the cassette. The base 72 has openings 274 therein. The openings 274 correspond to the positions of the spools in the cassette (not shown) (omitted for direct thermal material). A further opening 276 is provided in the base 72 which corresponds to the position of an internal locking core 278 in the cassette. The locking core 278 is for cooperation with the previously described locking mechanism of a label printer. The locking core 278 comprises locking projections 280, guided ribs 282 and chamfer(s) 284 for guidance of the knob of the previously described locking mechanism. The core 278 is substantially cylindrical in shape with a chamfered upper portion 284. The bottom of the core is open and corresponds to the opening 276 in the base of the cassette housing for receiving the previously described locking mechanism. The top of the core has an opening 286 for receiving the elongate knob of the locking mechanism. The opening 286 corresponds to the opening 94 in the top of the cassette housing.

Operation of the locking mechanism will now be described.

On insertion of the cassette into the cassette-receiving bay, the locking mechanism is received in the locking core of the cassette. The elongate knob passes through the opening in the top of the locking core so as to extend through the cassette and out through the opening in the top of the cassette housing. The elongate knob is of a length whereby the knob can be actuated when the cassette is housed in the cassette-receiving bay. Guide ribs on the interior of the core cooperate with corresponding guide ribs on the fixed part of the locking mechanism. Furthermore, the core comprises the locking projections which extend radially inwards. As the cassette is inserted, the projections of the core cooperate with the projections on the locking part of the locking mechanism causing the locking part to rotate in a clockwise direction on insertion of the cassette. After the projections of the core pass below the projections on the locking part, the locking part is spring biased to move in an anti-clockwise direction moving the locking part projections to a position above the projections of the core thus preventing the cassette from moving an upwards direction. In this position, the ribs of the internal core cooperate with the ribs of the locking mechanism so as to correctly align the cassette.

The position of the projections of the core determine the position of the cassette in the height direction in the cassette receiving bay.

On actuation of the elongate knob in a downwards direction, the locking mechanism rotates in a clockwise direction with the projections of the locking mechanism moving from a position above the projections of the core to a position adjacent to the projections of the core. The cassette then is free to move in an upward direction under the influence of the ejector plate (see above description of ejecting the cassette for more details).

In a preferred embodiment the projections of the locking mechanism and internal core are trapezoidal or approximately trapezoidal in cross-section having complementary sloped surfaces which abut during insertion of the cassette.

In the presently described embodiment, the base of the cassette and the base of the cassette receiving bay are perpendicular to the spool on which the tape is mounted. In an alternative arrangement in which the cassette is laterally inserted into the cassette receiving bay, the base of the cassette and the base of the cassette receiving bay are parallel to the spool on which the tape is mounted.

One key feature of embodiments of the present invention is that the locking mechanism is located between the side walls of the cassette, located away/spaced from the side walls, and preferably located approximately centrally in the cassette receiving bay for cooperation with an opening in a base of a cassette housing when a cassette is inserted into the cassette receiving bay.

The above-described locking mechanism is simple in construction and easy to manufacture. The mechanism is also compact for use in small handheld printers. In particular, because the locking mechanism of embodiments of the invention is arranged to extend from the base of the cassette receiving bay and through an opening in the base of the cassette, the need for a locking mechanism around the periphery of the cassette receiving bay is avoided. That is, locking mechanisms according to embodiments of the present invention are located within the cassette when the cassette is loaded into the printer rather than outside the cassette acting on an outer surface thereof. This results in a reduction in the size of the device. Good alignment and locking of the cassette in the cassette-receiving bay is achieved resulting in good print quality even when the printer is moved during printing.

An important advantage for a locking mechanism with an ejecting arrangement is the fact that it is a lot more easy to insert and remove a cassette, certainly when the printer is designed for a wide range of widths for image receiving medium having different cassette sizes.

As an alternative to the rotatable locking mechanism described above, the locking part may be movable in a linear path in a first direction and biased in a second direction opposite to the first direction whereby when a cassette is inserted into the cassette receiving bay, the locking part extends through an opening in a base of the cassette.

According to another embodiment of the present invention, the locking mechanism may be linked to the printhead and/or platen for moving the printhead and/or platen into a printing position when a cassette is inserted into the cassette-receiving bay and for moving the printhead and/or platen into a non-printing position when the cassette is ejected.

While this invention has been particularly shown and described with reference to preferred embodiments, it will be understood to those skilled in the art that various changes in form and detail may be made without departing from the scope of the invention as defined by the appended claims.

Figure 25:
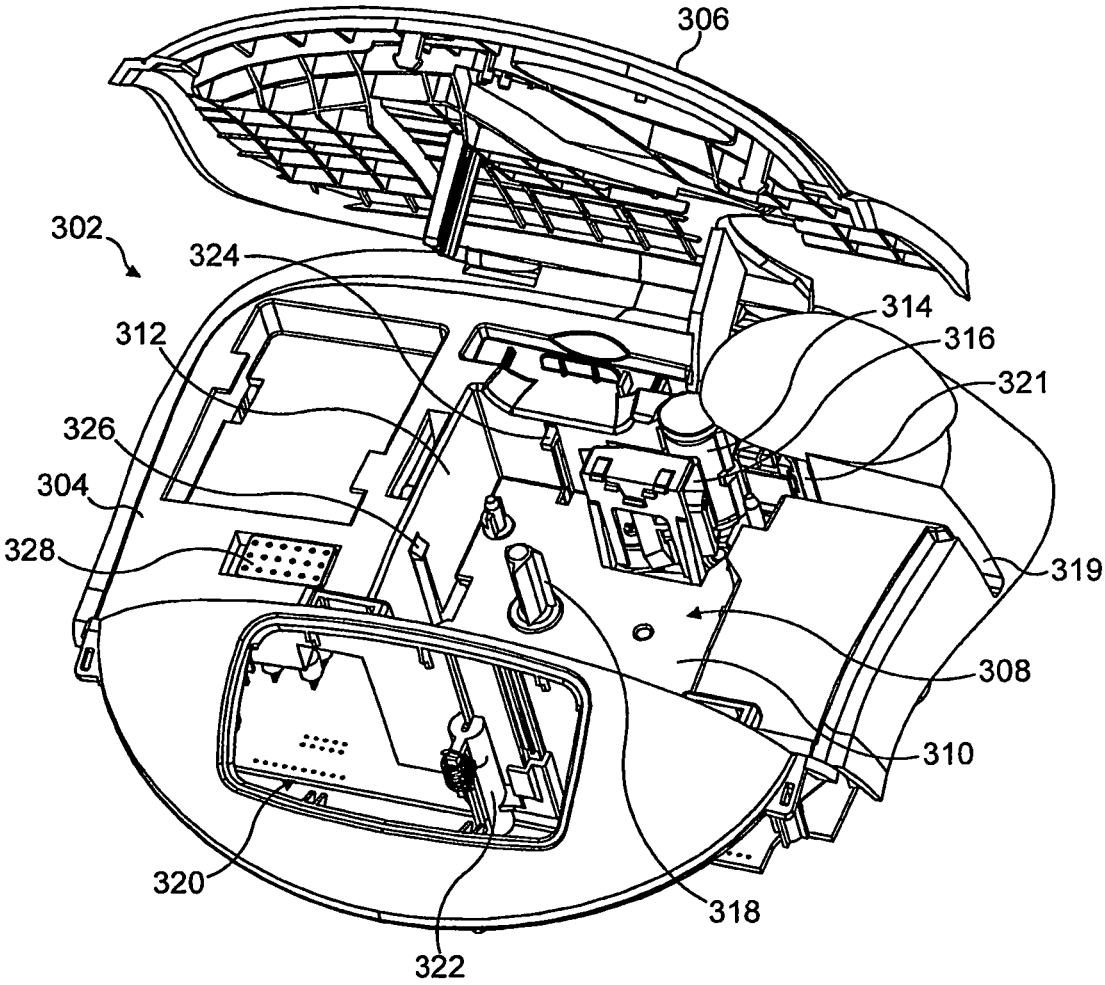
FIG. 25 is a top perspective view of a label printer according to an embodiment of the present invention, the label printer having it's lid open and no cassette present. A cutaway portion shows part of the interior of the label printer illustrating an ejector mechanism.

As stated above, FIG. 25 shows a top perspective view of a label printer 302 according to an embodiment of the present invention. The label printer 302 comprises a body 304, a lid 306 and a cassette-receiving bay 308. The cassette-receiving bay 308 has an opening in a top portion of the body for vertical insertion of a cassette. The lid 306 is hinged for closing over the top opening. The cassette-receiving bay 308 comprises a recess forming an opening for receiving a cassette. The recess is formed by a base 310 and sides 312 extending from the base 310 to the top opening. A platen 314 and a print head 316 are provided in the cassette-receiving bay 308. The print head 316 is movable towards the platen 314 whereby, during printing, the print head 316 co-operates with the platen 314, with tape passing there between for printing thereon. The platen 316 is driven by a motor (not shown) for propagating the tape during printing. An ink ribbon take-up sprocket 318 extends from the base 310 of the cassette-receiving bay 308 for cooperating with an ink ribbon take-up spool of a cassette when inserted into the cassette-receiving bay 308. The sprocket 318 is driven by a motor (not shown) for propagating the ink ribbon during printing. A slit 319 is provided in the body 304 of the label printer forming an exit through which the tape passes after printing. A cutting mechanism 321 is provided adjacent the exit slit 319 for cutting off the printed portion of tape to provide a printed label.

A cut-away portion 320 shows part of the interior of the label printer 302 illustrating an ejector mechanism 322. An ejector element 324 of a further ejector mechanism is visible on the opposite side of the cassette-receiving bay 308. A third ejector mechanism (which is not visible) is positioned on the right hand side of the cassette-receiving bay 308. Also visible in FIG. 25 is a locking element 326 of a locking mechanism on the left hand side of the cassette-receiving bay 308. A further locking element of the locking mechanism (which is not visible) is positioned on the right hand side of the cassette-receiving bay 308. An actuator button 328 is provided on the surface of the body 304 for actuating the locking mechanism.

Figure 26:
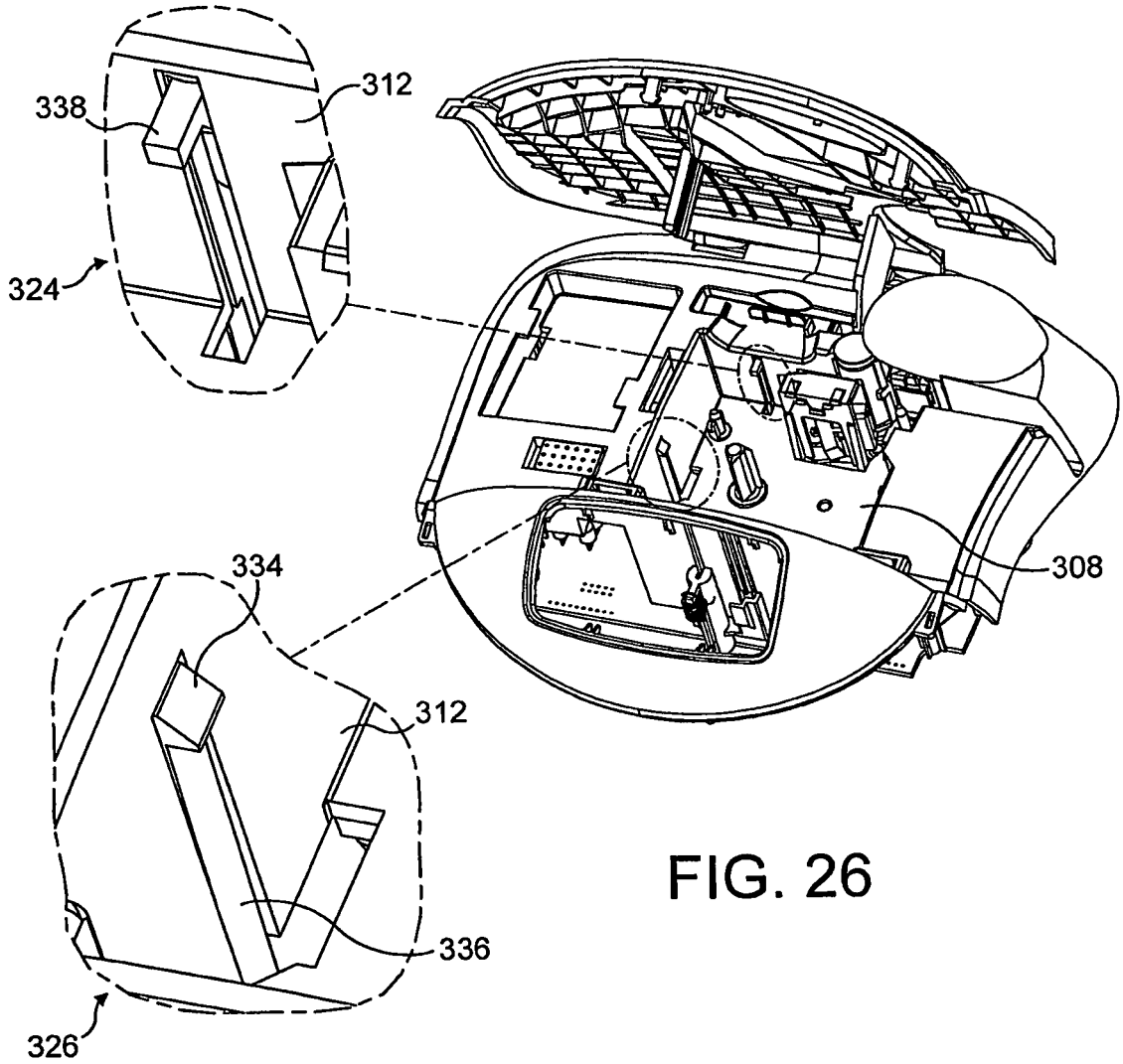
FIG. 26 is a top perspective view of the label printer of FIG. 25 illustrating the position of a first locking mechanism and a first ejector mechanism.
Figure 27:
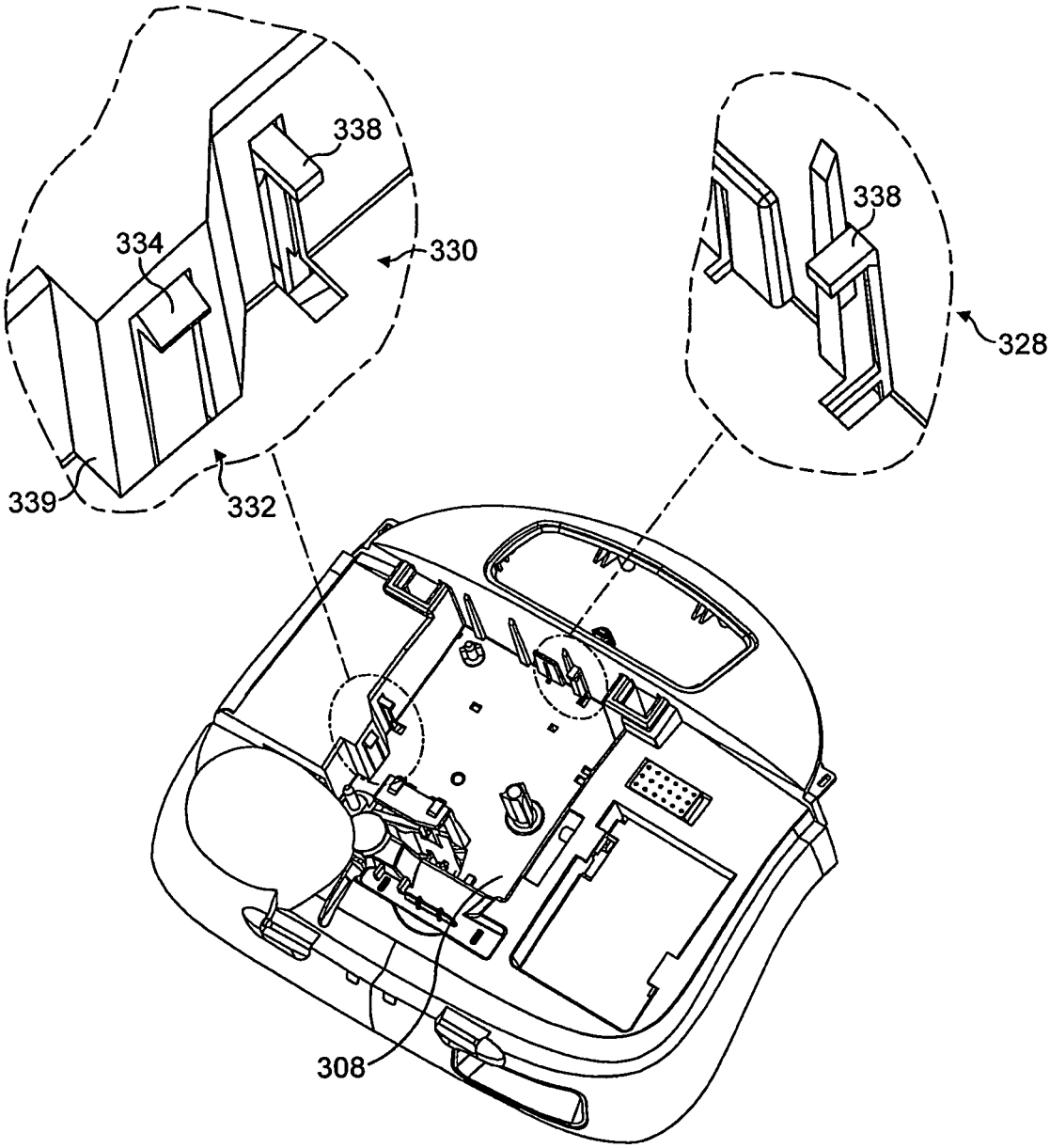
FIG. 27 shows a top perspective view of the label printer of FIG. 25 illustrating the position of a second ejector mechanism and a second locking mechanism (the lid is not shown for clarity)

FIG. 26 shows a similar view of the label printer 302 to that of FIG. 25 and illustrates the position of a first ejector element 324 and a first locking element 326. FIG. 27 shows a different view of the label printer 302 illustrating the position of a second and third ejector elements 328, 330 and a second locking element 332 (the lid of the label printer is not shown for clarity). The locking and ejector elements 324, 326, 328, 330, 332 are provided at the sides of the cassette-receiving bay 308 and extend into the cassette-receiving bay 308 through openings in the sides for interaction with an inserted cassette.

Each locking element 326, 332 comprises a projection 334 and an elongate element 336 extending in a direction from the base 310 to the top opening of the cassette-receiving bay 308. The projection 334 is at a top opening end of the elongate element 336 and extends towards a central portion of the cassette-receiving bay 308 through a corresponding opening in the side wall 312 of the cassette-receiving bay 308. Each projection 334 has a sloped upper surface for cooperating with a cassette inserted into the cassette-receiving bay 308 for moving the locking element from a locking position to an unlocked position. One of the side walls of the cassette-receiving bay 308 has a portion projecting 339 into the cassette-receiving bay forming a guide for a corresponding recess in a cassette when inserted into the cassette-receiving bay. The locking element 332 is positioned in an opening in the guide 339 and extends there from into the cassette-receiving bay 308 thereby forming a combined guiding and locking arrangement.

Each ejecting element 324, 328, 330 extends from the side wall of the cassette-receiving bay 308 part way into the cassette-receiving bay 308 and has a free end unconnected to any other structural elements. The ejector elements 324, 328, 330 comprise an elongate element 338 extending in a perpendicular direction relative to the side wall through an opening in the side wall.

Figure 28:
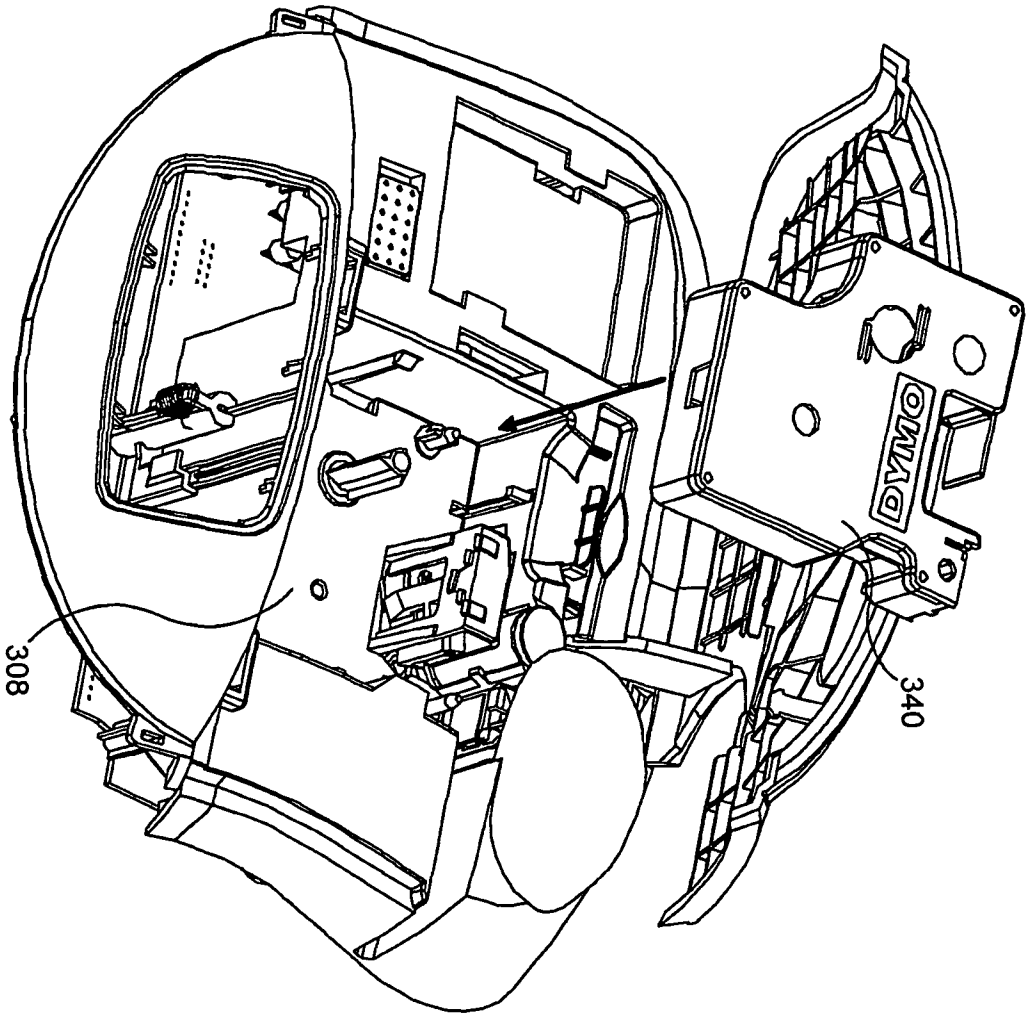
FIG. 28 shows a top perspective view of the label printer of FIG. 25 illustrating insertion of a cassette into the cassette-receiving bay of the label printer.
Figure 29:
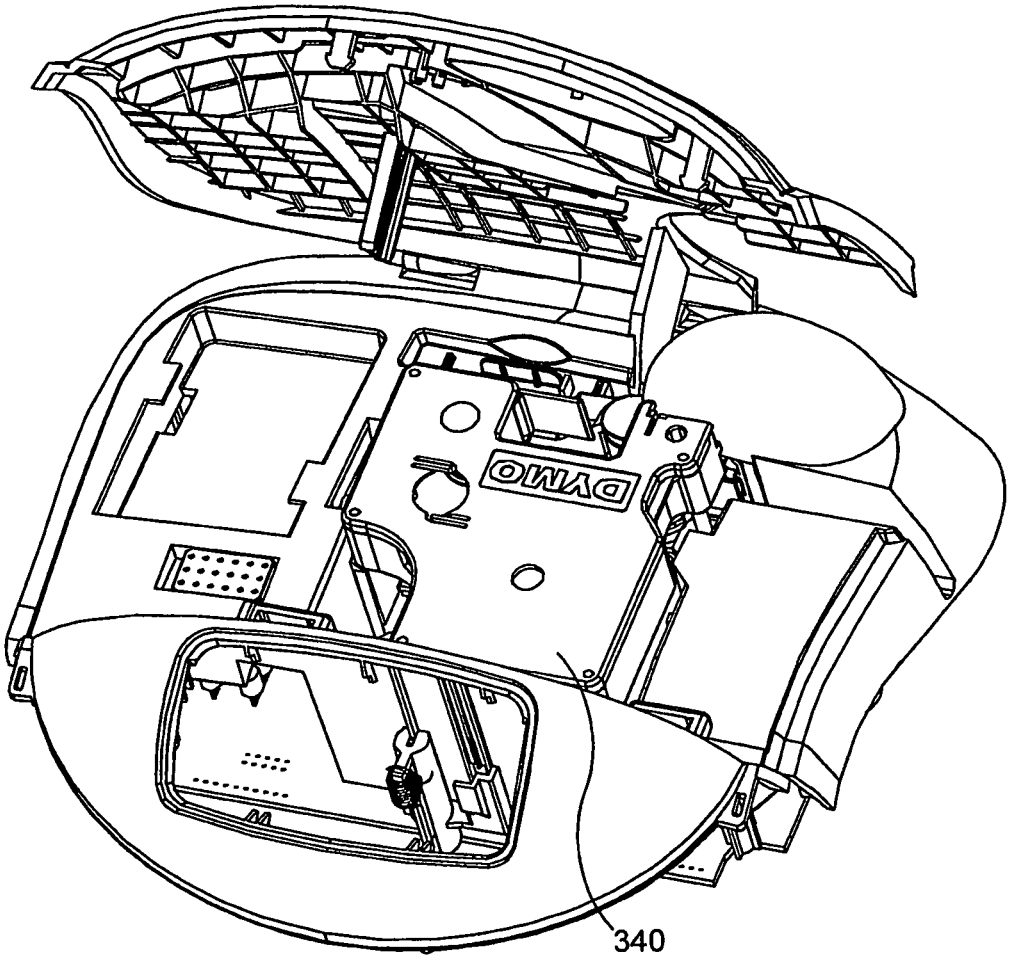
FIG. 29 shows a top perspective view of the label printer of FIG. 25 illustrating insertion of the cassette into the cassette-receiving bay of the label printer.
Figure 30:
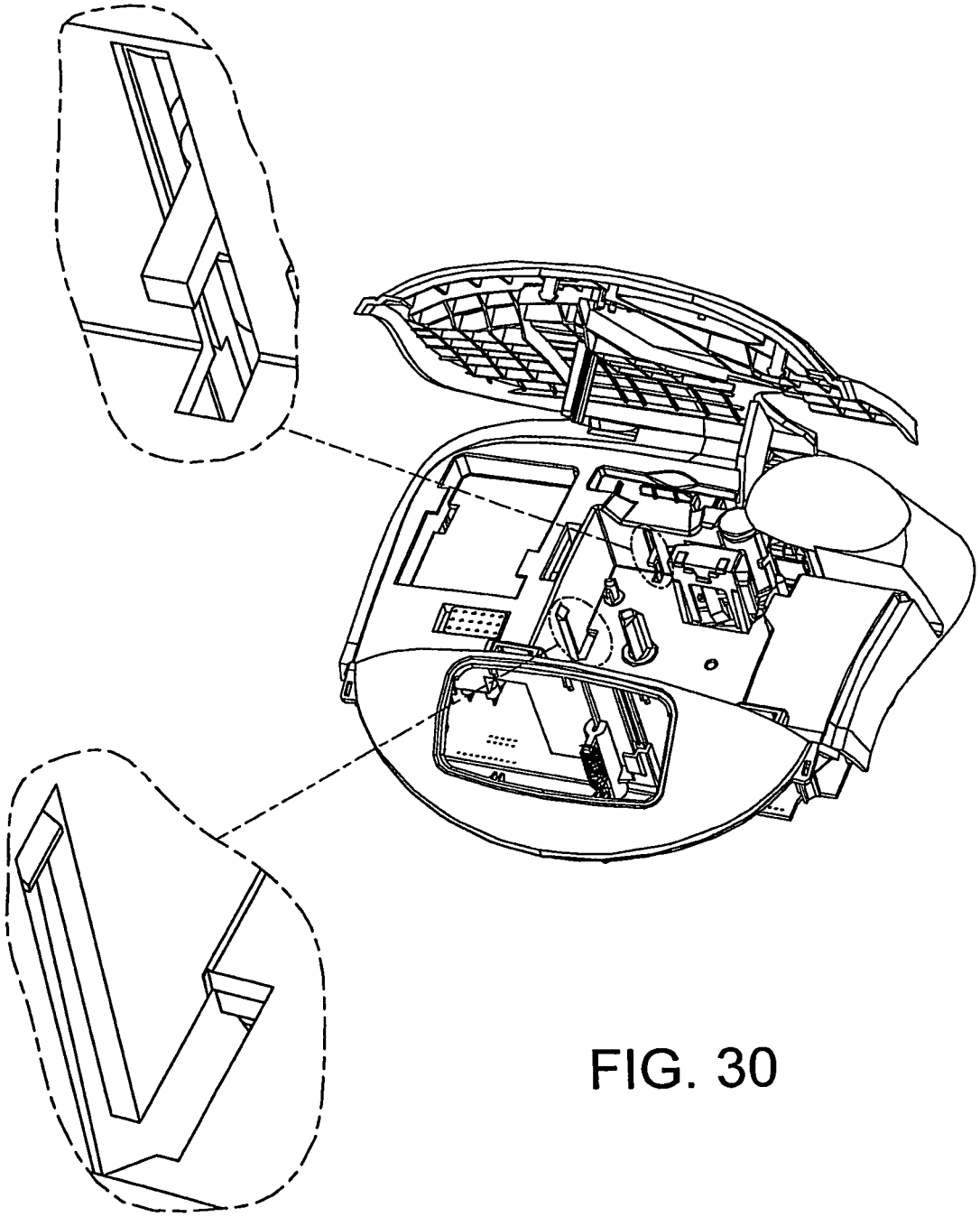
FIG. 30 shows a top perspective view of the label printer of FIG. 25 illustrating the positions of the first locking and ejector mechanisms as the cassette is being inserted (the cassette is not shown for clarity)
Figure 31:
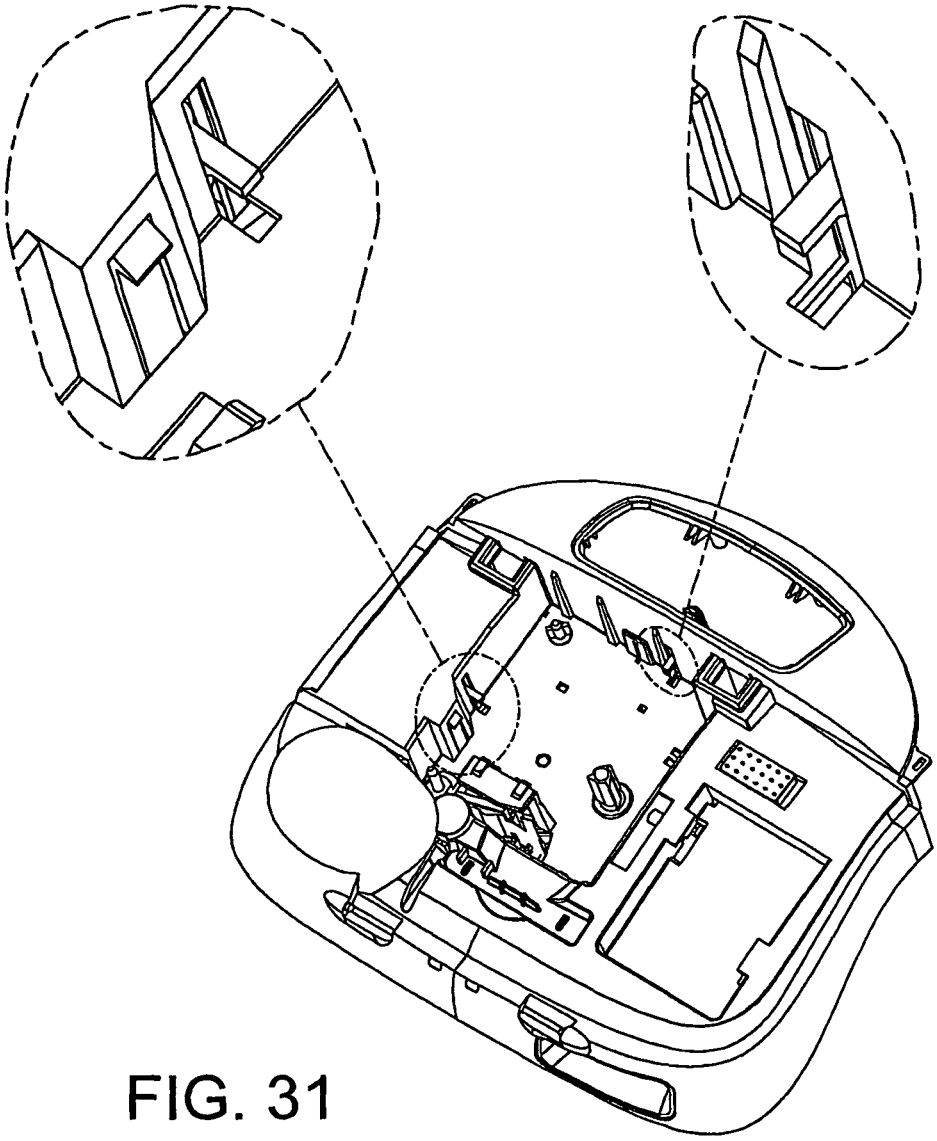
FIG. 31 shows a top perspective view of the label printer of FIG. 25 illustrating the positions of the second locking and ejector mechanisms as the cassette is being inserted (the cassette and the lid are not shown for clarity)

FIGS. 28 and 29 illustrate a cassette 340 being inserted into the cassette-receiving bay 308 from a top side thereof. FIGS. 30 and 31 illustrate the positions of the locking and ejecting elements 324, 326, 328, 330, 332 when the cassette is being inserted into the cassette-receiving bay 308. In FIGS. 30 and 31 the cassette is not shown for clarity.

Figure 32:
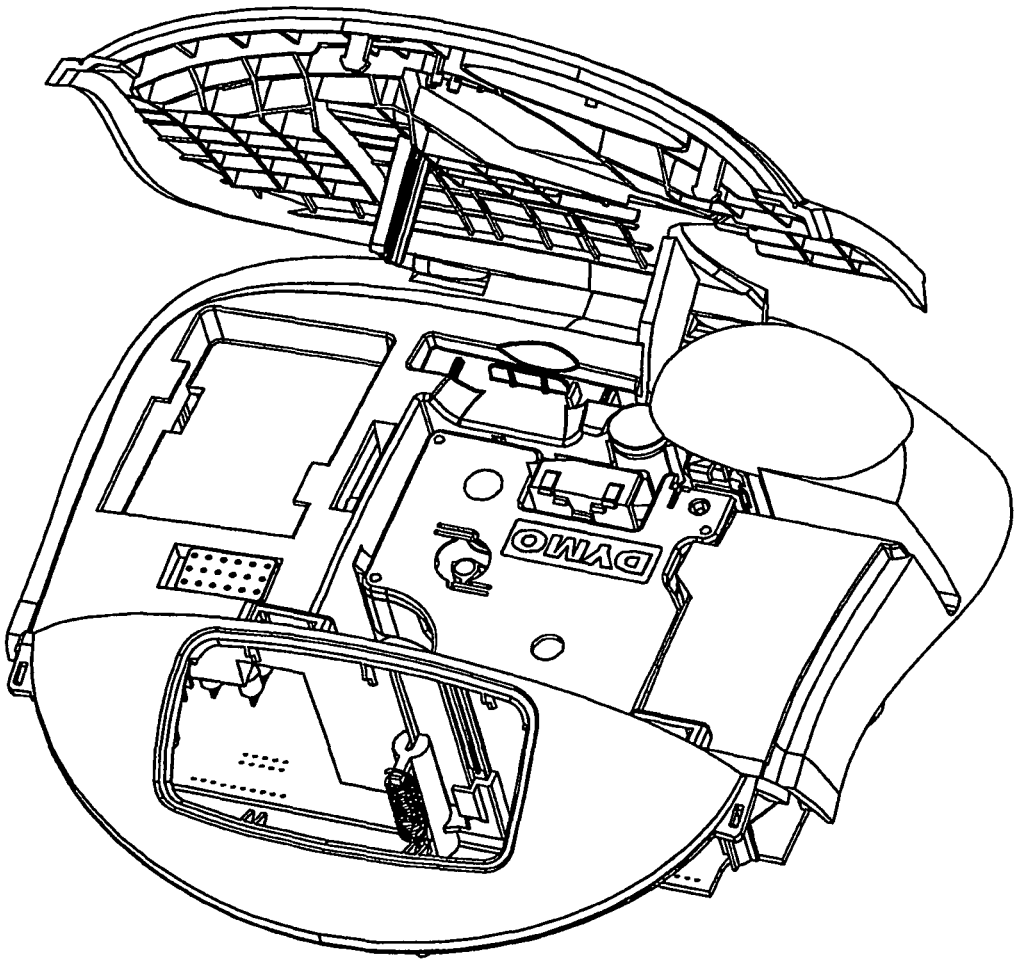
FIG. 32 shows a top perspective view of the label printer of FIG. 25 with the cassette fully inserted, locked and centred in the cassette-receiving bay of the label printer.

During insertion, the cassette contacts the locking and ejector elements. The projections of the locking elements have sloped upper surfaces such that as the cassette is inserted the locking elements are pushed backwards by the cassette into corresponding openings in the side walls. The locking elements are in their unlocked position. The locking elements are spring loaded to move into the locking position when the cassette is fully loaded as shown in FIG. 32. In FIG. 32, the cassette is locked and centered. The locking elements prevent the cassette from moving in an upward direction by interacting with locking features in the cassette. The ejectors are spring loaded and cooperate with an underside of the cassette.

Figure 33:
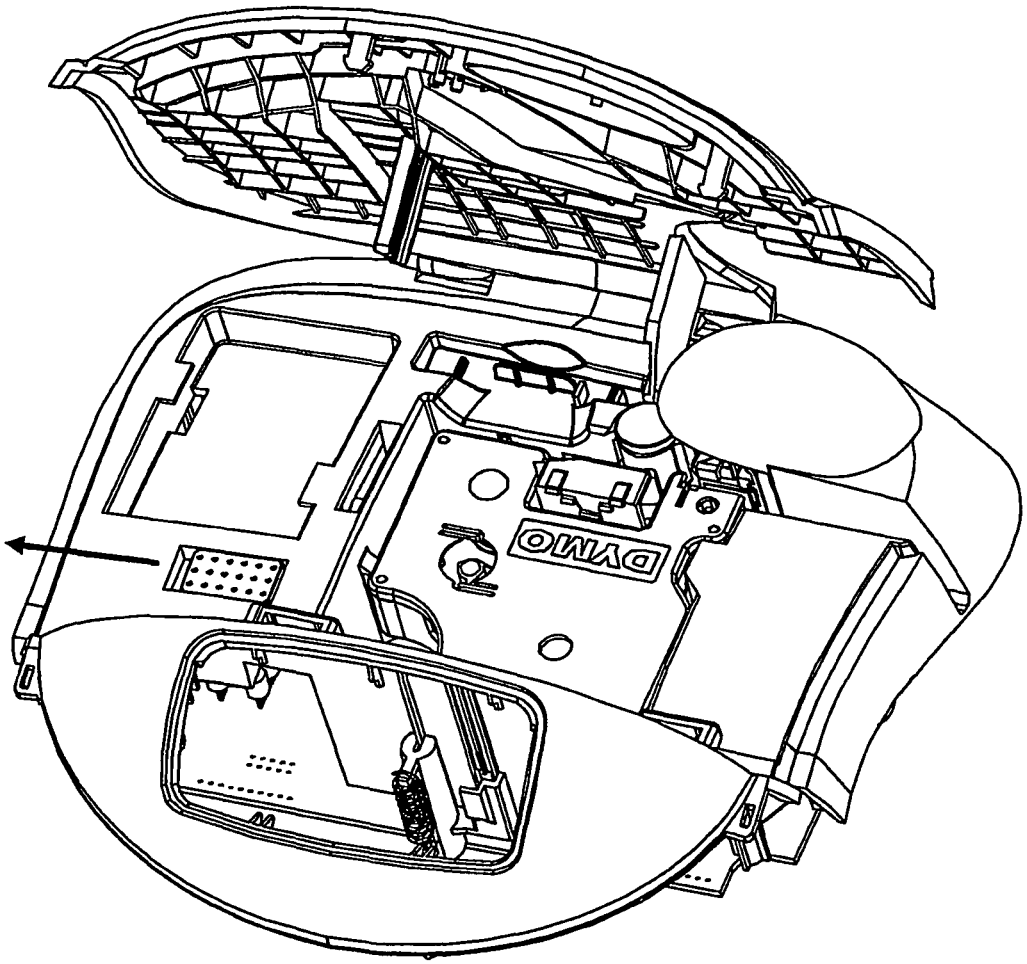
FIG. 33 shows a top perspective view of the label printer of FIG. 25 illustrating actuation of an ejector button for unlocking and ejecting the cassette.
Figure 34:
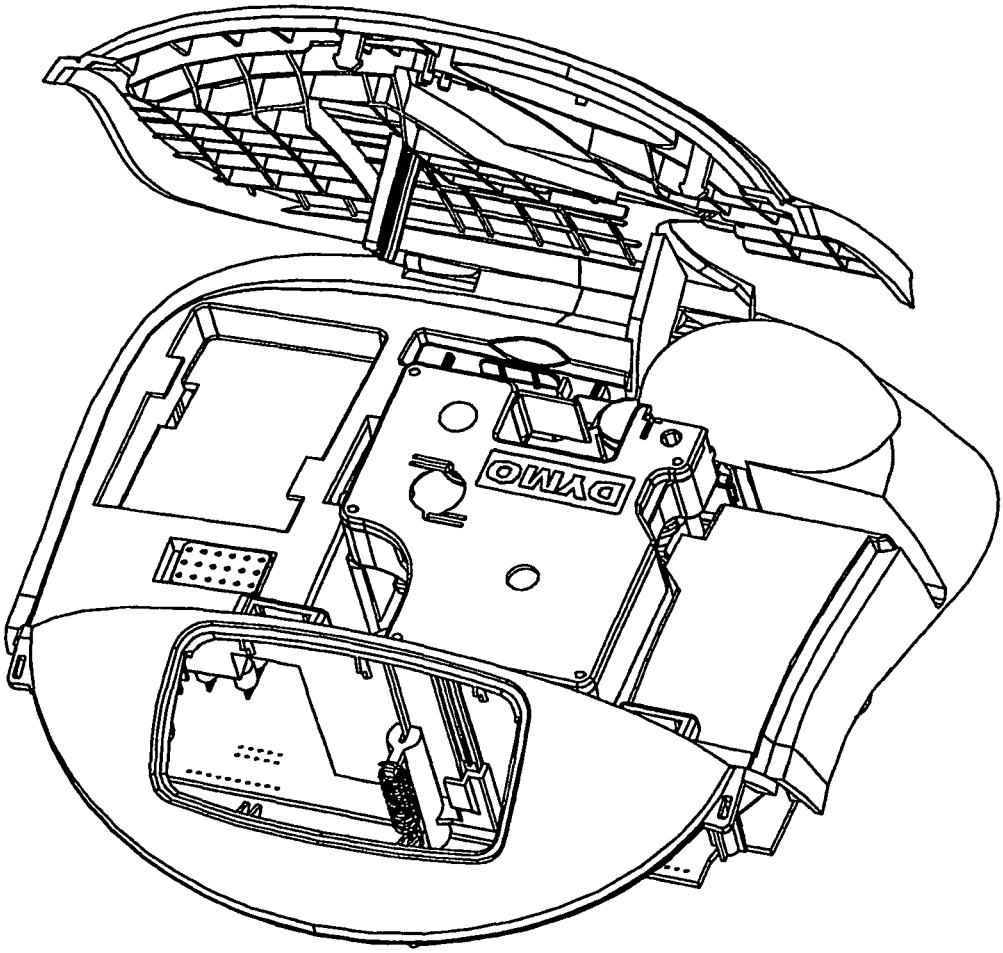
FIG. 34 shows a top perspective view of the label printer of FIG. 25 illustrating the cassette being ejected from the cassette-receiving bay after actuation of the ejector button.

FIGS. 33 and 34 illustrate unlocking. The ejector button is actuated to the left unlocking the mechanism by moving the locking elements backwards into their corresponding openings in the side walls of the cassette-receiving bay. The cassette is thus released and the ejectors push the cassette upwards for easy removal from the printer.

Figure 35:
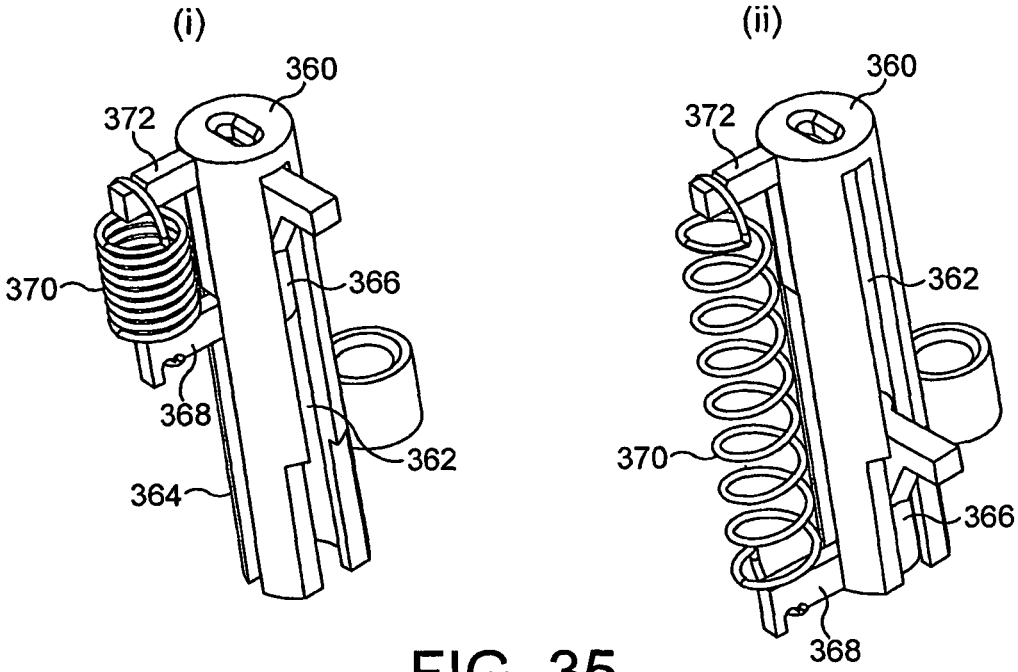
FIG. 35 shows two views of the ejector mechanism: (i) in a home position; and (ii) in an extended position as when a cassette is received in the cassette-receiving bay.

FIG. 35 illustrates the structure of the ejector mechanisms in more detail. The ejectors comprise an ejector housing 360 having two elongate openings 362, 364 therein. An ejector element 366 extends through one of the elongate openings 362 and a biasing member 368 extends through the other elongate opening 364. A spring 370 is provided between the biasing means and a fixed extension 372 on an upper portion of the housing 360. The ejector mechanism is arranged in the label printer such that the ejector element 366 extends through an opening in a side wall into the cassette receiving bay.

FIG. 35 shows two views of the ejector mechanism: (i) in a home position; and (ii) in an extended position as when a cassette is received in the cassette-receiving bay. During insertion of a cassette into the cassette-receiving bay, the cassette pushes down on the ejector element moving it from the position illustrated in FIG. 35(*i*) to the position illustrated in FIG. 35(*ii*). When fully inserted the locking elements hold the cassette thereby preventing the ejector mechanisms from pushing the cassette out of the cassette-receiving bay. When the locking elements are released, each ejector element is biased by its spring to move from the position illustrated in FIG. 35(*ii*) to the position illustrated in FIG. 35(*i*) thereby ejecting the cassette from the cassette-receiving bay.

Figure 36:
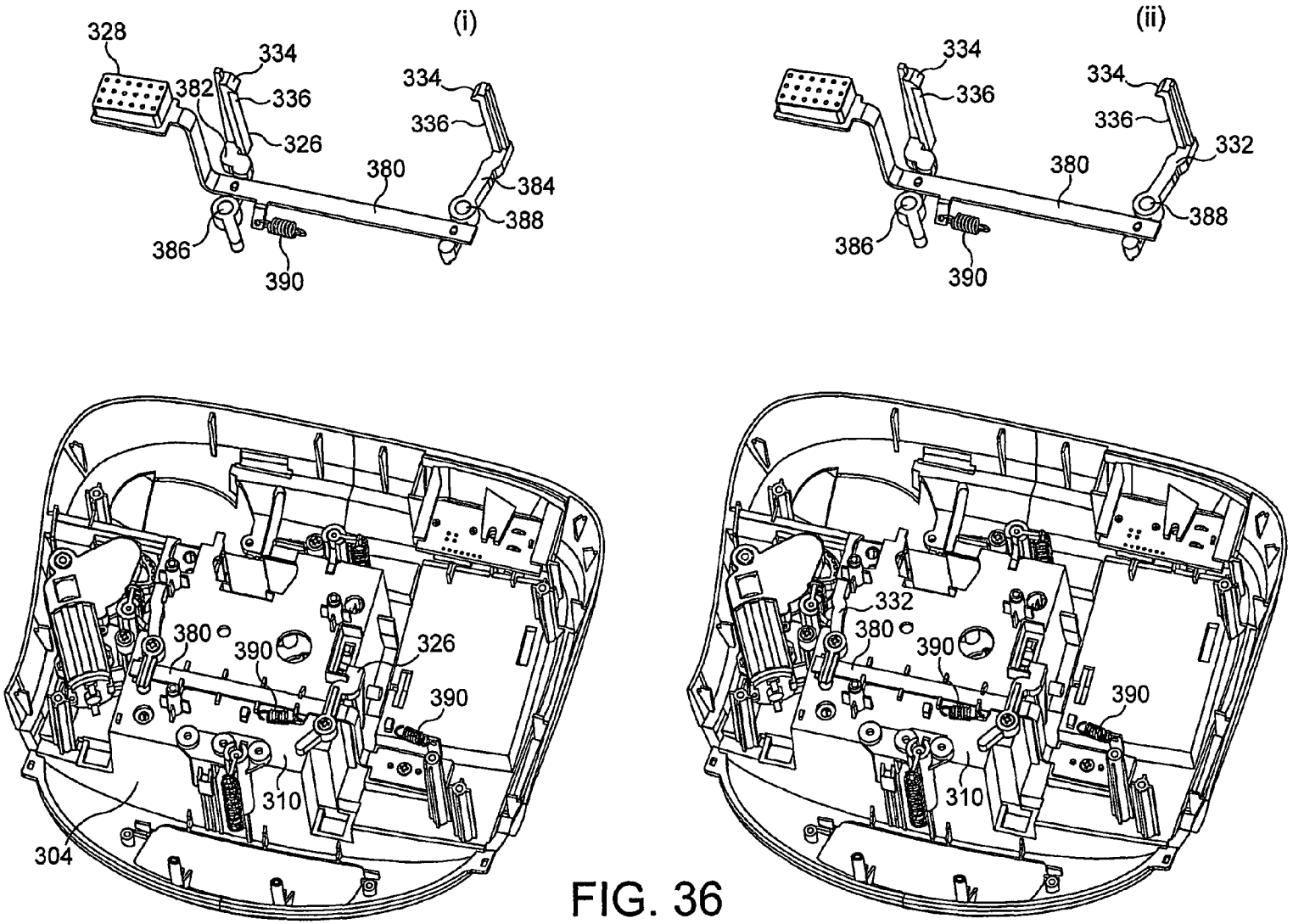
FIG. 36 shows two views of the locking mechanism: (i) in a closed/home/locking position; and (ii) in open/unlocked position.

FIG. 36 shows the locking mechanism in more detail. Two views of the locking mechanism are illustrated: (i) in a closed/home/locking position; and (ii) in open/unlocked position.

The locking mechanism comprises the two locking elements 326, 332. As described previously, the locking elements each comprise an elongate element 336 and a projection 334. Each projection 334 has a sloped upper surface for cooperating with a cassette inserted into the cassette-receiving bay for moving the locking elements 326, 332 from the locking position to the unlocked position. The locking elements 326, 332 are coupled together by an actuating bar 380. Each of the locking elements 326, 332 is coupled to the actuating bar 380 by a respective coupling member 382, 384 extending in a perpendicular direction relative to the locking element. The coupling between the actuating bar 380 and the locking elements 326, 332 is adapted to allow the locking elements to move in a rotational direction while the actuating bar 380 is moved in a linear direction. That is, a slot is provided in the actuating bar 380 with some free play between the coupling members 382, 384 and the actuating bar 380 to allow the coupling members 382, 384 to rotate when the actuating bar 380 is moved in a linear direction.

The locking elements 326, 332 have respective centres of rotation 386, 388 on opposite sides of the actuating bar 380 to each other. The centres of rotation 386, 388 comprise pivot points attached to the printer housing 304. A return springs 390 are provided for biasing the locking elements towards the locking position. The actuating bar 380 has a portion extending substantially parallel with the base 310 of the cassette-receiving bay and a portion extending substantially perpendicular to the base, the locking elements 326, 332 being coupled to the parallel portion and the actuating button 328 being coupled to an end of the perpendicular portion. Actuation of the button towards the left causes the locking element 326 to rotate in a counter-clockwise direction and the locking element 332 to rotate in a clockwise direction as viewed. On release of the actuating button 328 the biasing springs 390 cause the actuating bar to move to the right, the locking element 326 to rotate in a clockwise direction and the locking element 332 to move in a counter-clockwise direction.

Figure 37:
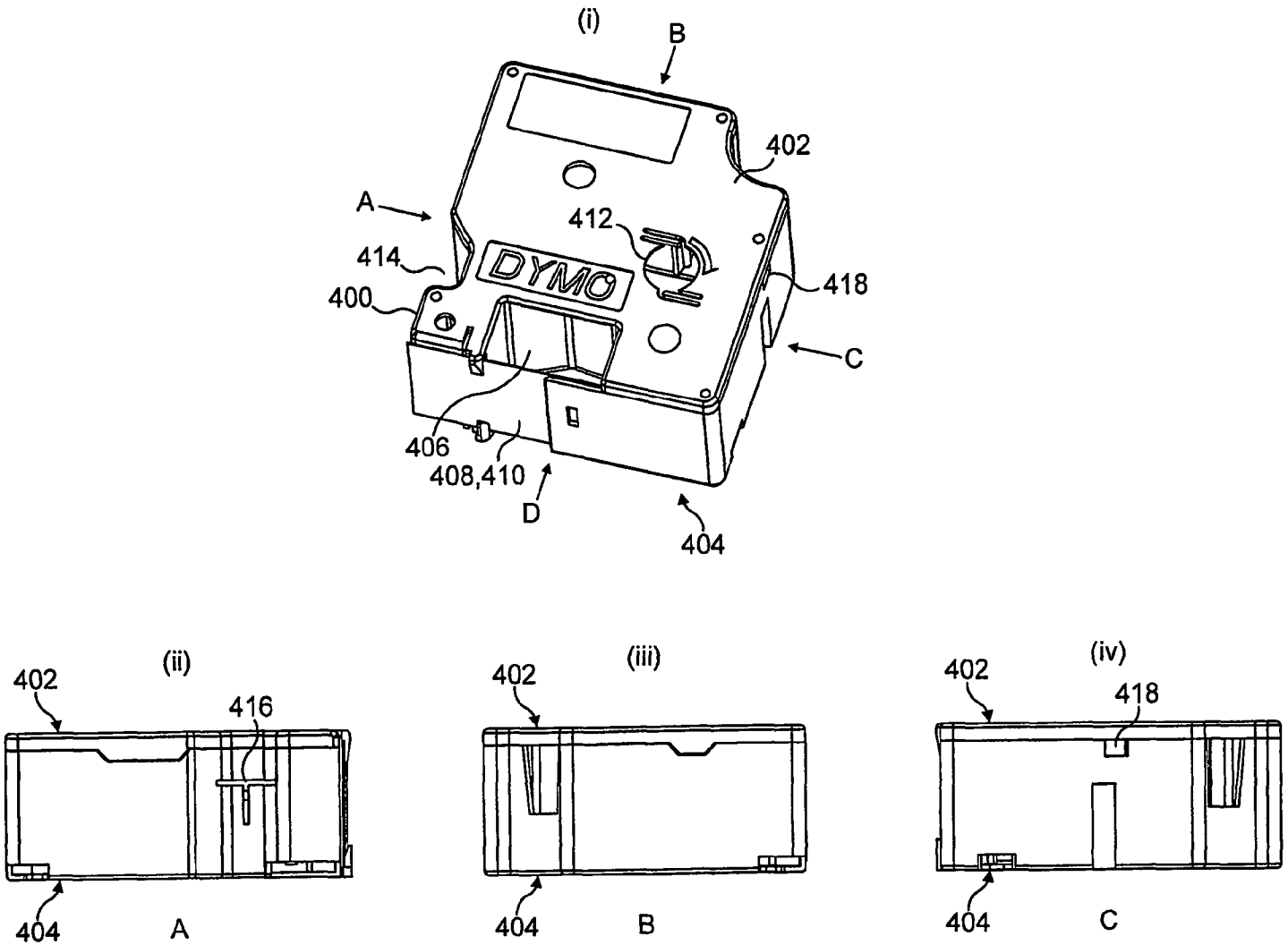
FIG. 37 shows four views of a 24 mm cassette: (i) a top perspective view; (ii) side A; (iii) side B; and (iv) side C.

FIG. 37 shows four views of a 24 mm cassette: (i) a top perspective view; (ii) side A; (iii) side B; and (iv) side C.

The cassette 400 comprises a housing having a top 402, a base 404, and side surfaces A, B, C and D. The cassette houses an ink ribbon and a print receiving tape. An opening 406 is provided in the cassette housing through which the printhead of the label printer passes when the cassette is inserted into the cassette-receiving bay of the label printer. The tape and ink ribbon 408, 410 pass the opening 406 whereby the ink ribbon and tape 408, 410 are nipped between the platen and the printhead of the printer in use. An ink ribbon take-up spool 412 is provided which cooperates with a sprocket in the printer for driving the ink ribbon during printing.

As shown in FIG. 37(*i*) and (ii), side A of the cassette comprises a recess 414 extending from the base 404 to the top 402 of the cassette to form a guide. A locking element 416 is provided in the recess 414 in the form of a rib extending across the recess in a direction parallel to the base and the top of the cassette. Providing the locking element 416 in a recess 414 saves space and allows for a smaller printer and/or a larger cassette. As shown in FIG. 37(*iii*), side C of the cassette comprises another locking element 418 in the form of an opening in the side wall for cooperating with a locking element of the printer.

The recess 414 and locking element 416 of the label cassette may be arranged to form a combined guiding and locking arrangement which cooperates with a complementary guiding and locking arrangement in the cassette-receiving bay of the printer.

Figure 38:
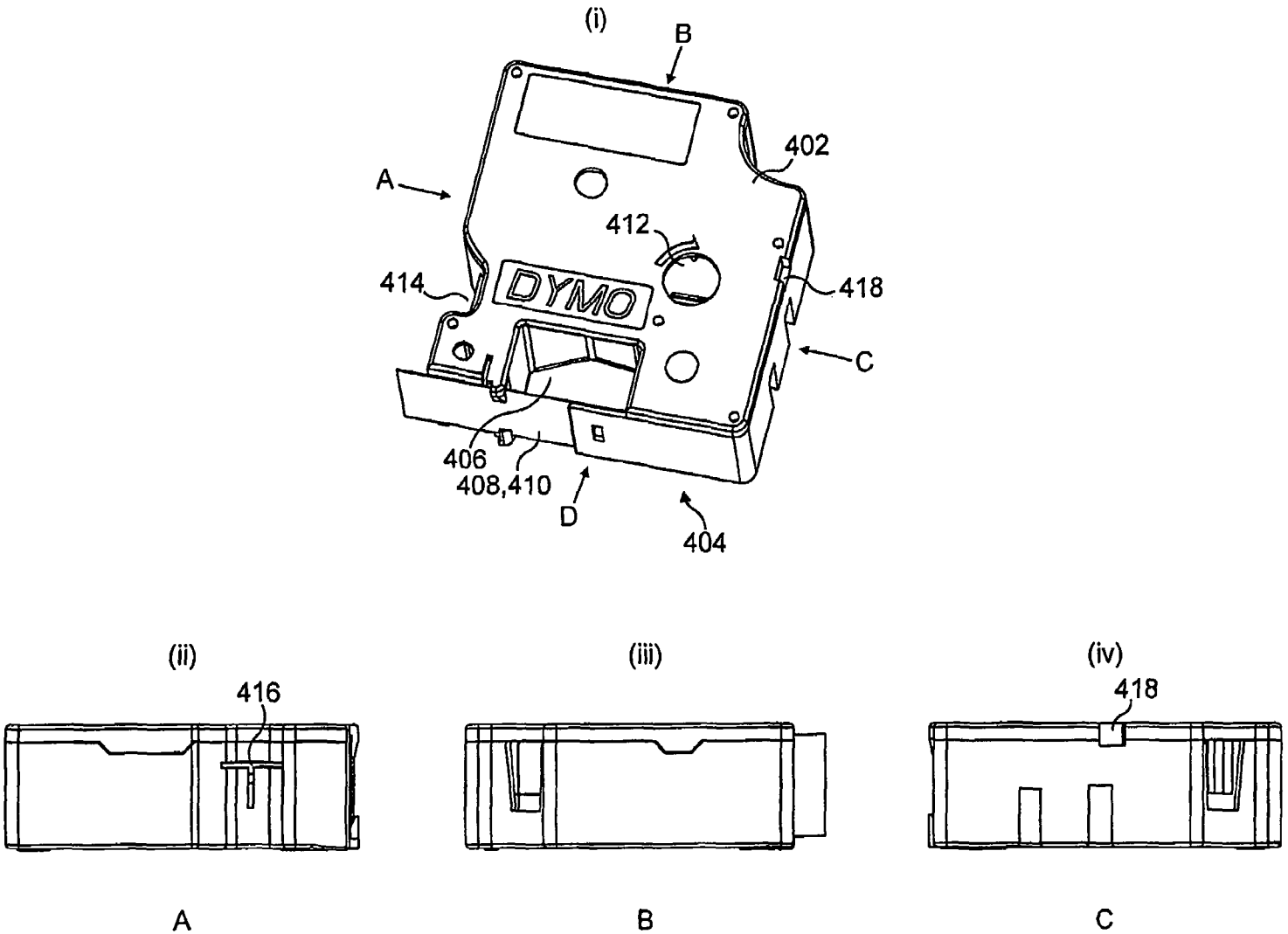
FIG. 38 shows four views of a 19 mm cassette: (i) a top perspective view; (ii) side A; (iii) side B; and (iv) side C.
Figure 39:
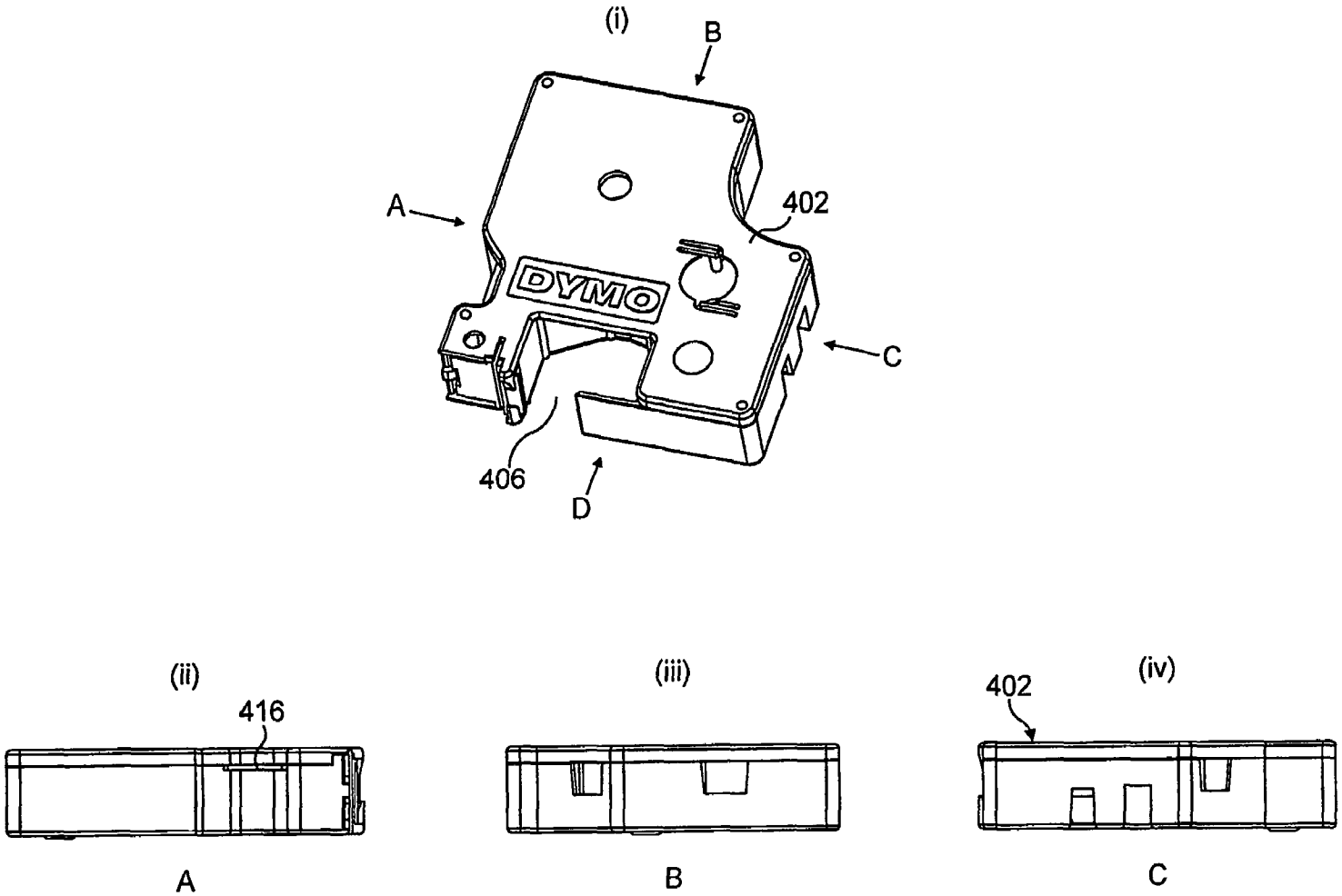
FIG. 39 shows four views of a 12 mm cassette: (i) a top perspective view; (ii) side A; (iii) side B; and (iv) side C.

FIGS. 38 and 39 show similar structural features of a 19 mm cassette and a 12 mm cassette. The cassettes form a set comprising label cassettes of differing widths as measured from the base to the top. It can be seen by comparing FIGS. 37 to 39 that the ratio of a distance between the base and the locking elements and a distance between the locking elements and the top increases on decreasing width. That is, the smaller the width of the cassette then the higher the locking elements are located on the cassette. In fact, the 12 mm cassette does not have an locking opening in side C at all and in this case the top of the label cassette 402 interacts with the locking element 326 in the printer. This aforementioned arrangement allows for label cassettes of differing widths to be positioned and locked in the correct printing position in a label printer The above described ejector and locking arrangement is simple in construction and easy to manufacture. The arrangement is also compact for use in small handheld printers. In particular, because the main parts of the ejector and locking mechanisms are located outside the cassette-receiving bay, either at the side or underneath the base, more space is available for the other printing elements. This can result in a reduction in size of the printer.

An important advantage for a locking mechanism with an ejecting arrangement is the fact that it is a lot easier to insert and remove a cassette, certainly when the printer is designed for a wide range of widths for image receiving medium having different cassette sizes. Good alignment and locking of the cassette in the cassette-receiving bay is achieved resulting in good printing quality, even when the printer is moved during the printing.

According to another embodiment of the invention, the locking mechanism may be linked to the print head and/or platen for moving the print head and/or platen into a printing position when a cassette is inserted in the cassette-receiving bay and for moving the print head and/or platen into a non-printing position when the cassette is ejected.

While this invention has been particularly shown and described with reference to preferred embodiments, it will be understood to those skilled in the art that various changes in form and detail may be made without departing from the scope of the invention as defined by the appending claims.

The invention claimed is:

1. A label printer comprising a cassette-receiving bay, said cassette-receiving bay having a base, a top opening opposite the base, and a locking mechanism comprising two locking elements extending to the cassette-receiving bay for locking a cassette in the cassette-receiving bay, wherein each locking element is moveable between a locking position and an unlocked position, the two locking elements being linked by an actuator mechanism positioned below the base of the cassette-receiving bay, wherein each of the locking elements is coupled to the actuator mechanism by a respective coupling member so as to synchronize movement of the two locking elements, and wherein the respective coupling members extend in a perpendicular direction relative to the locking element, wherein the actuator mechanism comprises a lever mechanism and an actuating bar and the two locking elements are rotationally coupled to the actuating bar for rotating in opposite directions on actuation of the lever mechanism.

2. A label printer according to claim 1, wherein the locking mechanism comprising a biasing means for biasing the locking elements towards the locking position.

3. A label printer according to claim 2, wherein the biasing means is arranged to act on the actuating bar.

4. A label printer according to claim 1, wherein the locking elements have respective centers of rotation on opposite sides of the actuating bar to each other.

5. A label printer according to claim 1, wherein the coupling between the actuating bar and the locking elements is adapted to allow the locking elements to move in a rotational direction while the actuating bar is moved in a linear direction.

6. A label printer according to claim 1, wherein the actuating bar has a portion extending substantially parallel with the base of the cassette-receiving bay and a portion extending substantially perpendicular to the base, the locking elements being coupled to the parallel portion and the actuating button being coupled to an end of the perpendicular position.

7. A label printer comprising a cassette-receiving bay, said cassette-receiving bay having a base, a top opening opposite the base, and a locking mechanism comprising one or more locking elements extending into the cassette-receiving bay for locking a cassette in the cassette-receiving bay, wherein each locking element is moveable between a locking position and an unlocked position, wherein each locking element is arranged to be moveable through a corresponding opening in a side wall of the cassette-receiving bay whereby in the locking position each locking element extends into the cassette-receiving bay and in the unlocked position each locking element is positioned within the corresponding opening in the side wall of the cassette-receiving bay; wherein a side wall of the cassette-receiving bay has a portion projecting into the cassette-receiving bay forming a guide for a corresponding recess in a cassette when inserted into the cassette-receiving bay, and wherein a locking element of the one or more locking elements extends from said guide thereby forming a combined guiding and locking arrangement.

* * * * *

UNITED STATES PATENT AND TRADEMARK OFFICE

CERTIFICATE OF CORRECTION

PATENT NO. : 8,540,444 B2
APPLICATION NO. : 11/658907
DATED : September 24, 2013
INVENTOR(S) : Vandermeulen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1625 days.

Signed and Sealed this
Fifteenth Day of September, 2015

Michelle K. Lee

Michelle K. Lee
*Director of the United States Patent and Trademark Office*